US008773311B2

(12) United States Patent
Ando et al.

(10) Patent No.: US 8,773,311 B2
(45) Date of Patent: Jul. 8, 2014

(54) RESONATOR ANTENNA AND COMMUNICATION APPARATUS

(75) Inventors: Noriaki Ando, Tokyo (JP); Hiroshi Toyao, Tokyo (JP)

(73) Assignee: NEC Corporation, Tokyo (JP)

( * ) Notice: Subject to any disclaimer, the term of this patent is extended or adjusted under 35 U.S.C. 154(b) by 318 days.

(21) Appl. No.: 13/203,195

(22) PCT Filed: Mar. 4, 2010

(86) PCT No.: PCT/JP2010/001511
§ 371 (c)(1),
(2), (4) Date: Aug. 24, 2011

(87) PCT Pub. No.: WO2010/100932
PCT Pub. Date: Sep. 10, 2010

(65) Prior Publication Data

US 2011/0304521 A1 Dec. 15, 2011

(30) Foreign Application Priority Data

Mar. 6, 2009 (JP) ..... 2009-054007

(51) Int. Cl.
*H01Q 1/38* (2006.01)

(52) U.S. Cl.
USPC ..... 343/700 MS; 343/702

(58) Field of Classification Search
USPC ..... 343/700 MS, 702, 829, 846
See application file for complete search history.

(56) References Cited

U.S. PATENT DOCUMENTS 5,309,163 A * 5/1994 Ngan et al. ..... 343/700 MS
5,754,143 A * 5/1998 Warnagiris et al. ..... 343/767
5,757,326 A * 5/1998 Koyama et al. ..... 343/702
6,278,407 B1 * 8/2001 Ashjaee et al. ..... 343/700 MS
6,300,908 B1 * 10/2001 Jecko et al. ..... 343/700 MS
6,429,819 B1 * 8/2002 Bishop et al. ..... 343/725
7,456,790 B2 * 11/2008 Isono et al. ..... 343/700 MS
2005/0134522 A1 6/2005 Waltho
2007/0176827 A1 8/2007 Itoh et al.

FOREIGN PATENT DOCUMENTS

EP 1 860 724 A1 11/2007
JP 2005-94360 A 4/2005
JP 2006-135595 A 5/2006
JP 2006245984 A 9/2006

(Continued)

OTHER PUBLICATIONS

International Search Report for PCT/JP2010/001511 mailed Jun. 1, 2010.

(Continued)

*Primary Examiner* — Tho G Phan
(74) *Attorney, Agent, or Firm* — Sughrue Mion, PLLC

(57) ABSTRACT

A resonator antenna includes a first conductor pattern as a first conductor, a second conductor pattern as a second conductor, a plurality of first openings, a plurality of interconnects, and a power feed line. The first conductor pattern has, for example, a sheet shape. The second conductor pattern has, for example, a sheet shape, and at least a portion thereof (which, however, may be nearly the entirety thereof) faces the first conductor pattern. A plurality of first openings is provided in the first conductor pattern. The interconnect is provided in each of a plurality of first openings, and one end thereof is connected to the first conductor pattern. The power feed line is connected to the first conductor pattern. Unit cells including the first opening and the interconnect are repeatedly, for example, periodically disposed.

24 Claims, 28 Drawing Sheets

(56) References Cited

FOREIGN PATENT DOCUMENTS

| | | | |
|---|---|---|---|
| JP | 2008131505 | A | 6/2008 |
| JP | 2008147763 | A | 6/2008 |
| WO | 02/103846 | A1 | 12/2002 |
| WO | 2008024993 | A | 2/2008 |

OTHER PUBLICATIONS

Chinese Office Action for CN Application No. 201080010621.8, issued on Jun. 25, 2013 with English Translation.
Japanese Office Action for JP Application No. 2011-502659 mailed on Mar. 18, 2014 with Partial English Translation.

* cited by examiner (a)

(b)

A—A´

(a)

(b)

(a)

(b)

(a)

(b)

110

RESONATOR ANTENNA AND COMMUNICATION APPARATUS

TECHNICAL FIELD

The present invention relates to a resonator antenna and a communication apparatus suitable for microwaves and millimeter-waves.

BACKGROUND ART

In recent years, in wireless communication devices and the like, miniaturization and thinning of antennas have been required. Resonator antennas such as a patch antenna and a wire antenna operate when the element size thereof is equivalent to wavelength of ½ of an electromagnetic wave propagating through a medium such as a dielectric. A dispersion relationship unique to a medium exists in the relationship between the wavelength and the frequency of an electromagnetic wave, and the medium depends on the dielectric constant and the magnetic permeability in a normal insulating medium. For this reason, when an operating band and a used substrate material are determined, the size of the resonator antenna may also be determined. For example, when the wavelength in a vacuum is set to $\lambda_0$, the dielectric constant of the substrate material is set to $\in_r$, and the magnetic permeability is set to $\mu_r$, the length d of one side of the resonator antenna is expressed by the following expression.

$$d=\lambda_0/(2\times(\in_r\times\mu_r)^{1/2})$$

As is obvious from the above-mentioned expression, it is required to use a substrate material having an extremely high dielectric constant and magnetic permeability in order to drastically reduce the size of the normal resonator antenna, and thus the manufacturing costs of the resonator antenna increase.

On the other hand, in recent years, a meta-material has been proposed in which the dispersion relationship of electromagnetic waves propagating through in a structure is artificially controlled by periodically arranging conductor patterns or conductor structures. It is expected that use of a meta-material will miniaturize the resonator antenna.

For example, Patent Document 1 discloses that a meta-material is formed by a conductor plane, a conductor patch disposed parallel to the conductor plane, and a conductor via that connects the conductor patch to the conductor plane, and that an antenna is created using this meta-material.

RELATED DOCUMENT

Patent Document

[Patent Document 1] US2007/0176827A1 (FIG. 6)

DISCLOSURE OF THE INVENTION

However, in a technique disclosed in Patent Document 1, it is required to form the conductor via that connects the conductor patch to the conductor plane. For this reason, the manufacturing costs increase.

An object of the invention is to provide a resonator antenna which is not required to form a conductor via and is capable of being miniaturized by using a meta-material, and a communication apparatus in which the resonator antenna is used.

According to the present invention, there is provided a resonator antenna including: a first conductor; a second conductor of which at least a portion faces the first conductor; a first opening provided in the first conductor; an interconnect, provided in the first opening, of which one end is connected to the first conductor; and a power feed line connected to the first conductor or the second conductor.

According to the invention, there is provided a resonator antenna including: a first conductor; a second conductor of which at least a portion faces the first conductor; a first opening provided in the first conductor; a third conductor having an island shape provided in the first opening separately from the first conductor; a chip inductor, provided in the third conductor, which connects the third conductor to the first conductor; and a power feed line connected to the first conductor or the second conductor.

According to the invention, there is provided a communication apparatus including: a resonator antenna; and a communication processing section connected to the resonator antenna, wherein the resonator antenna includes a first conductor, a second conductor of which at least a portion faces the first conductor, a first opening provided in the first conductor, an interconnect, provided in the first opening, of which one end is connected to the first conductor, and a power feed line connected to the first conductor or the second conductor.

According to the invention, there is provided a communication apparatus including: a resonator antenna; and a communication processing section connected to the resonator antenna, wherein the resonator antenna includes a first conductor, a second conductor of which at least a portion faces the first conductor, a first opening provided in the first conductor, a third conductor having an island shape provided in the first opening separately from the first conductor, a chip inductor, provided in the third conductor, which connects the third conductor to the first conductor, and a power feed line connected to the first conductor or the second conductor.

According to the invention, it is possible to provide a resonator antenna which is not required to form a conductor via and is capable of being miniaturized by using a meta-material, and a communication apparatus in which the resonator antenna is used.

Figure 7:
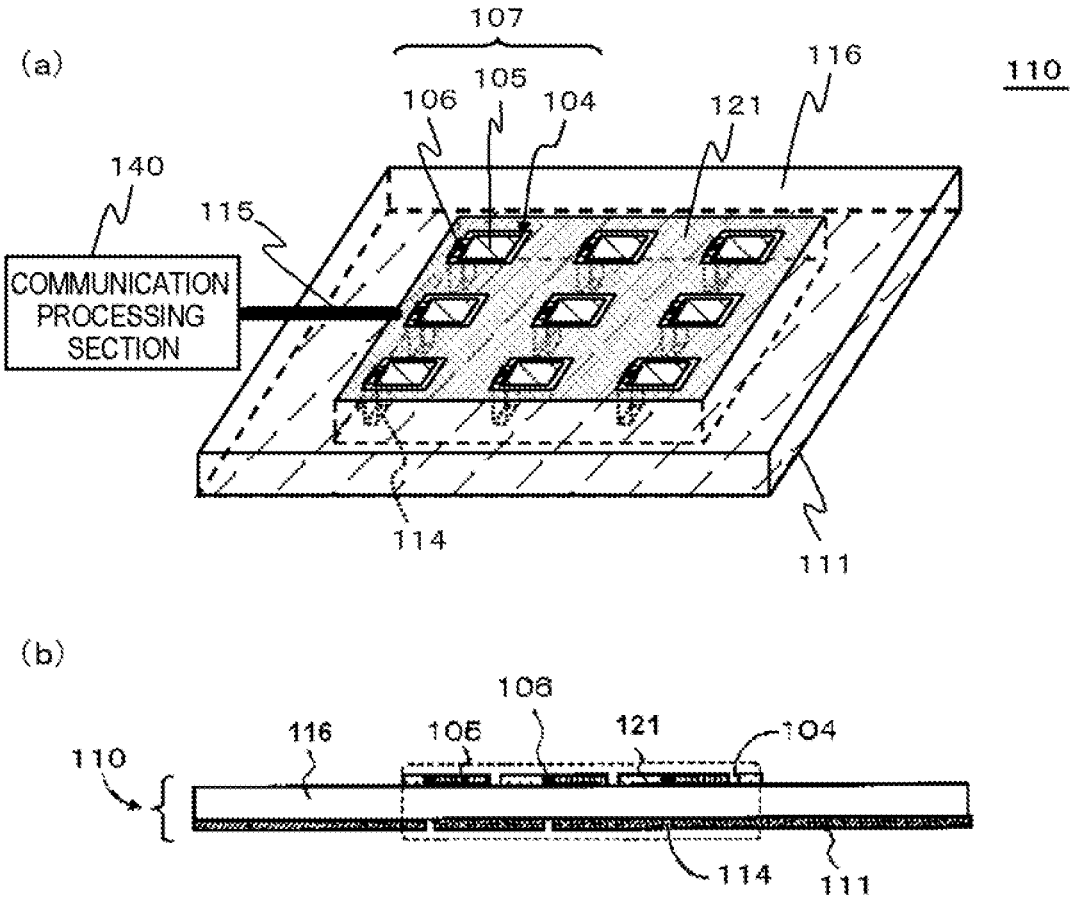
FIG. 7(*a*) is a perspective view illustrating the resonator antenna according to a second embodiment, and FIG. 7(*b*) is a cross-sectional view illustrating a configuration of the resonator antenna shown in FIG. 7(*a*).
Figure 8:
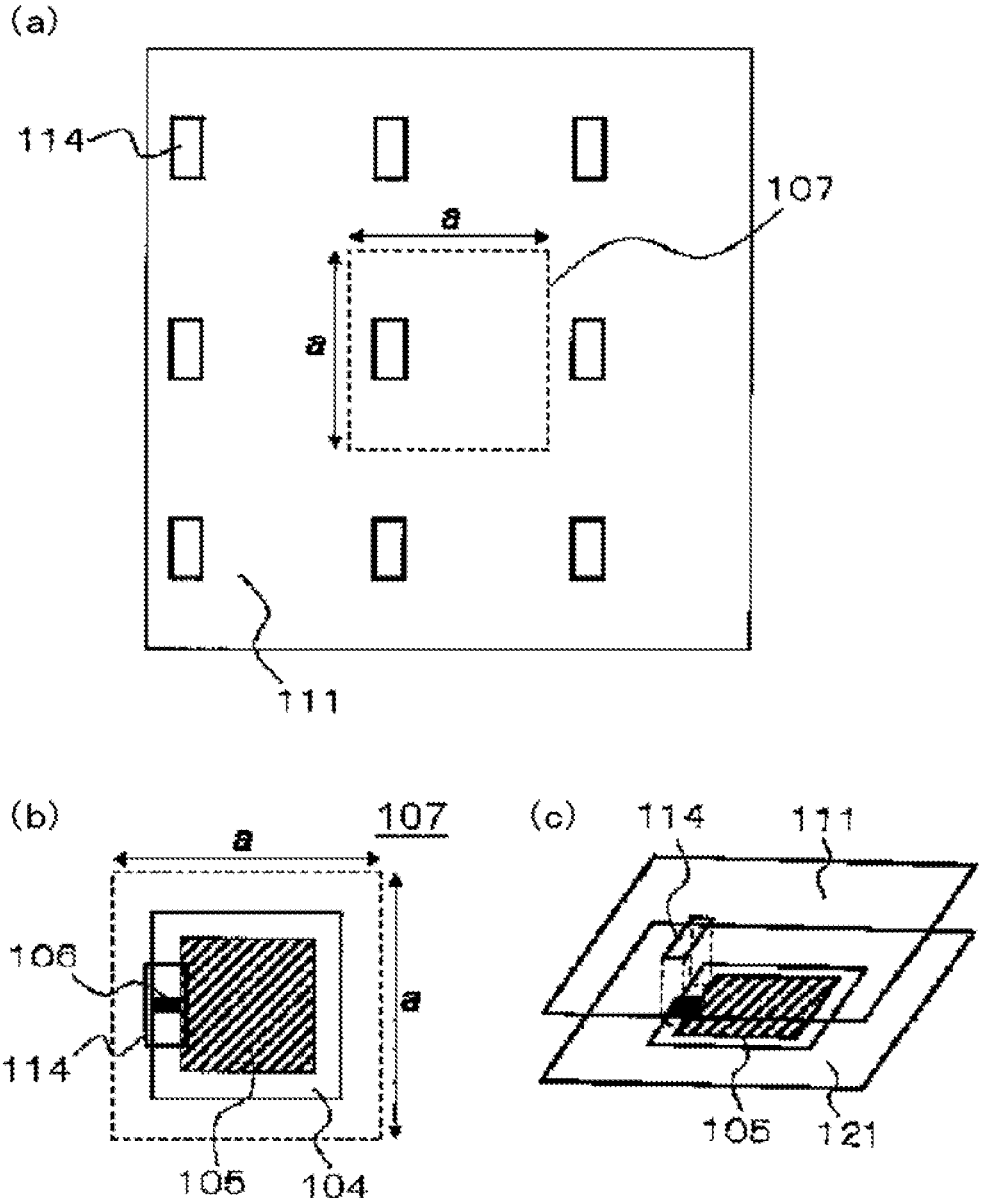
FIG. 8(*a*) is a plan view illustrating a second conductor pattern of the resonator antenna shown in FIG. 7(*a*), FIG. 8(*b*)

is a plan view when the unit cell of the resonator antenna shown in FIG. 7(*a*) is seen through the upper surface, and FIG. 8(*c*) is a perspective view illustrating the unit cell.

Figure 9:
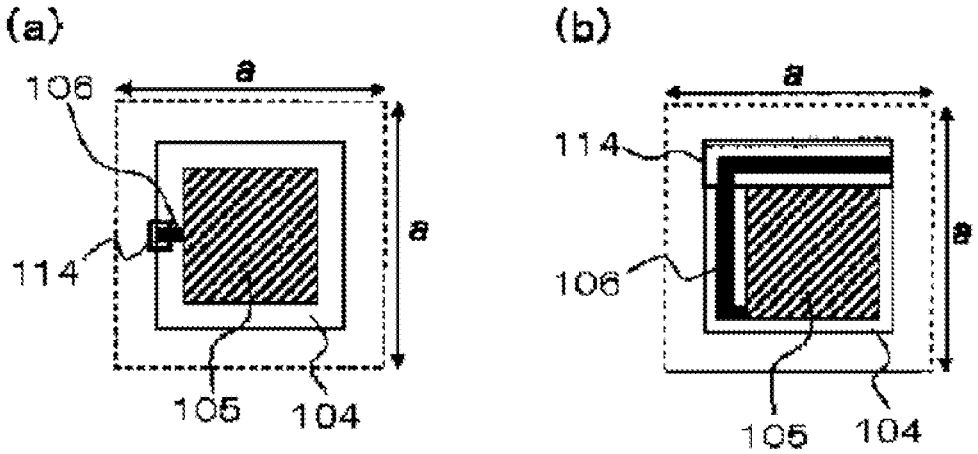

FIGS. 9 (*a-b*) are diagrams for explaining a modified example of FIG. 7.

Figure 10:
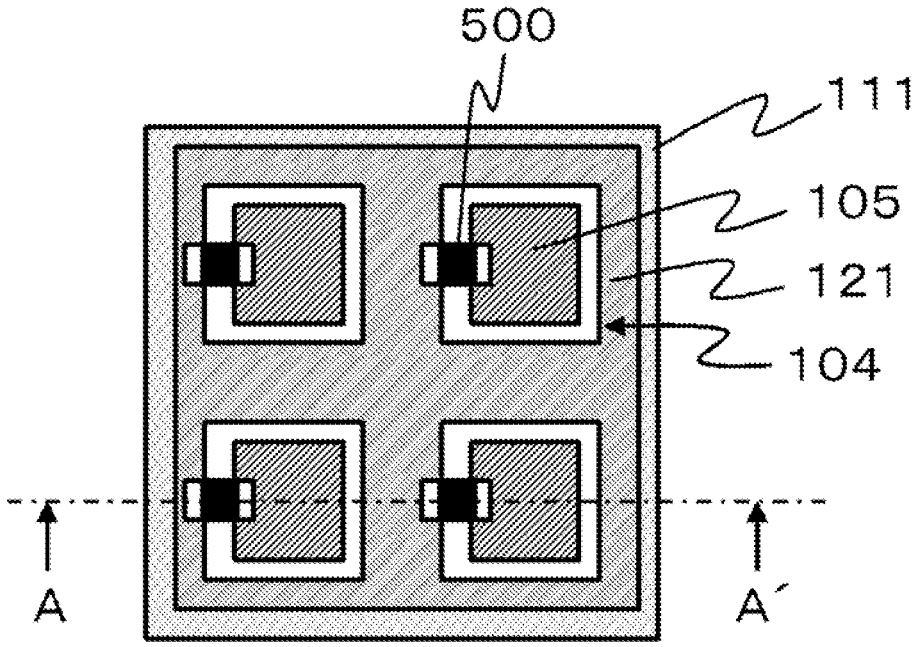
Figure 10:
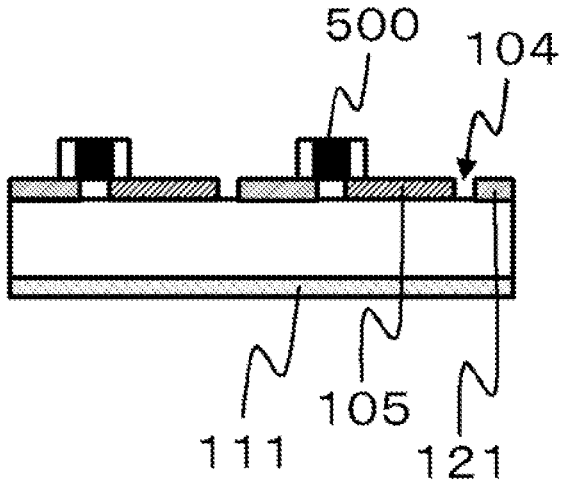

FIGS. 10 (*a-b*) are diagrams for explaining a modified example of the first and second embodiments.

Figure 11:
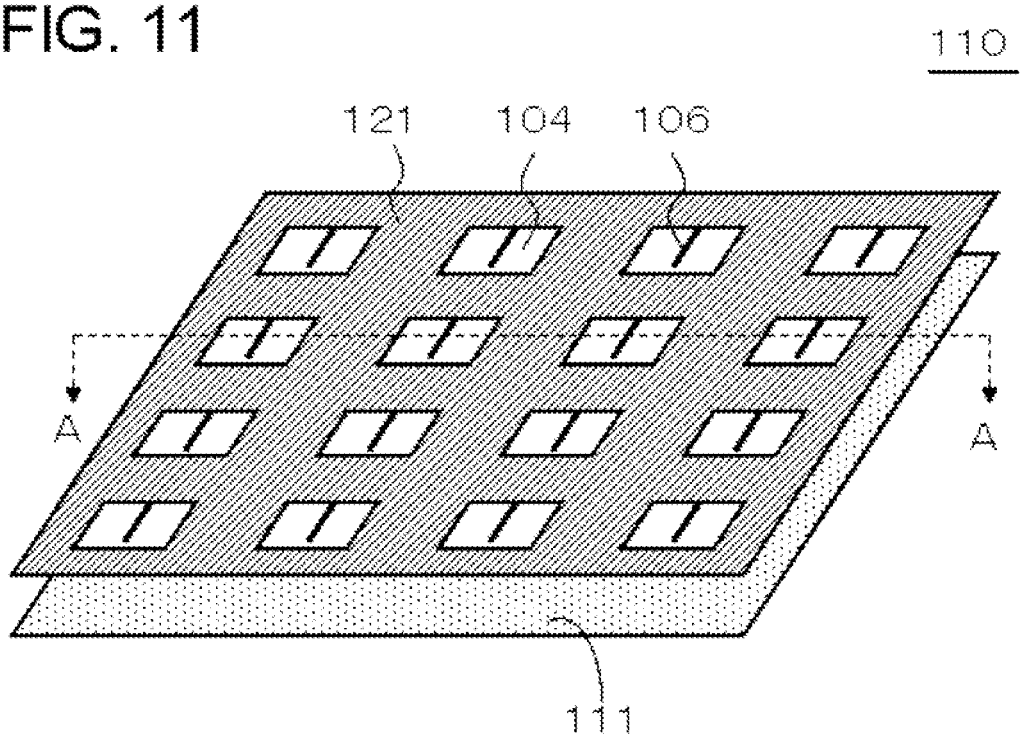

FIG. 11 is a perspective view illustrating the resonator antenna according to a third embodiment.

Figure 12:
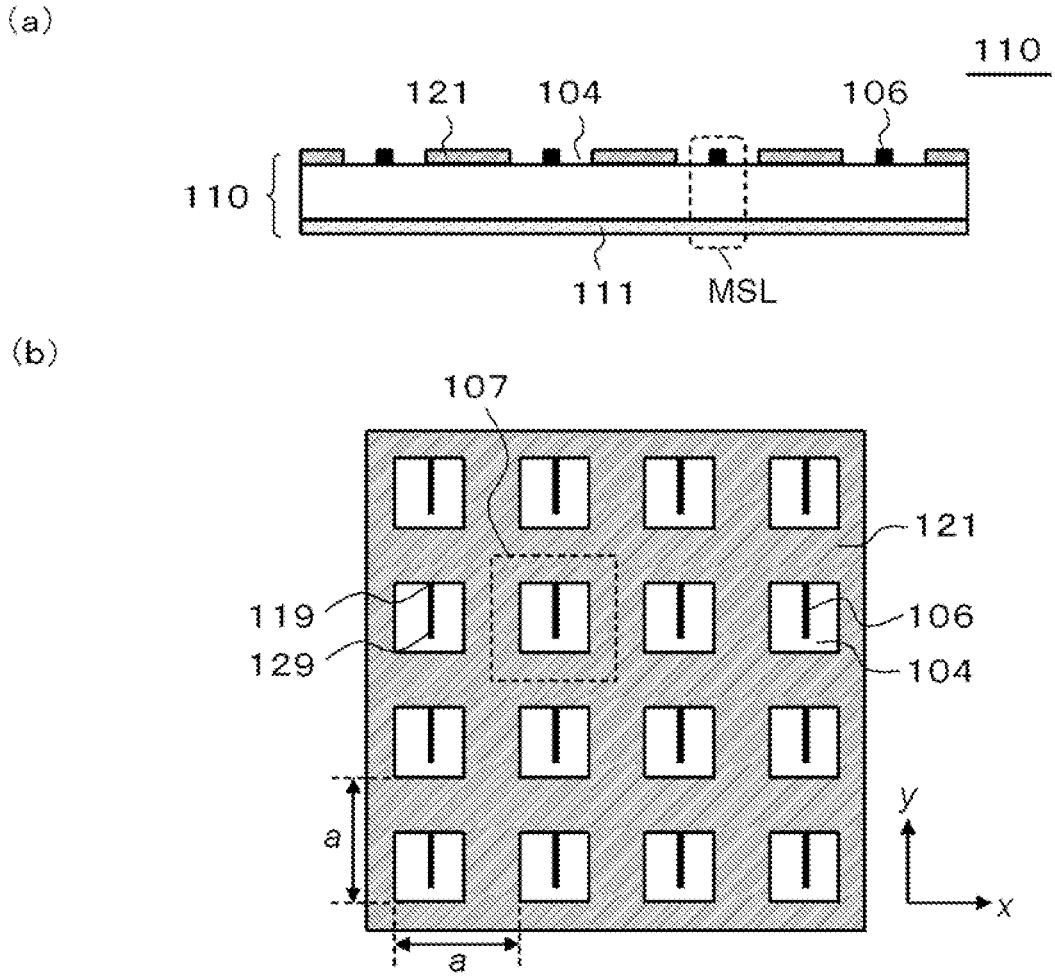

FIG. 12(*a*) is a cross-sectional view illustrating the resonator antenna shown in FIG. 11, and FIG. 12(*b*) is a plan view illustrating a layer provided with the first conductor pattern.

Figure 13:
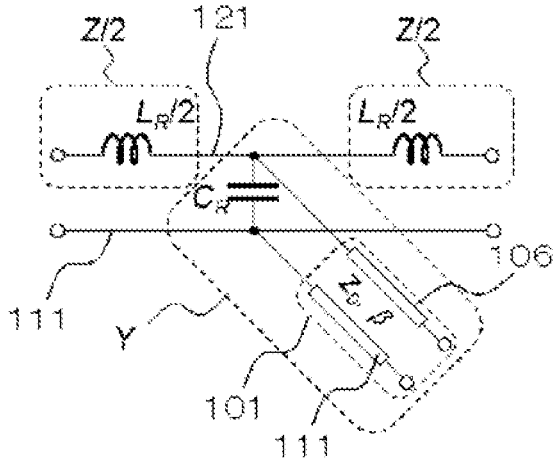
Figure 13:
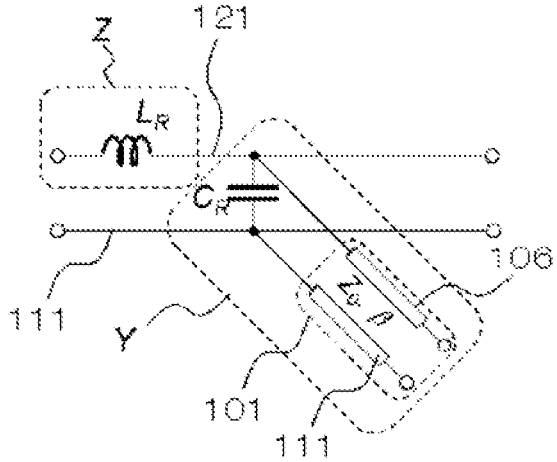

FIG. 13(*a*) is an equivalent circuit diagram of the unit cell shown in FIG. 12, and FIG. 13(*b*) is an equivalent circuit diagram of the unit cell when the unit cell shown in FIG. 12 is shifted by a half cycle of a/2 in the x direction in FIG. 12.

Figure 14:
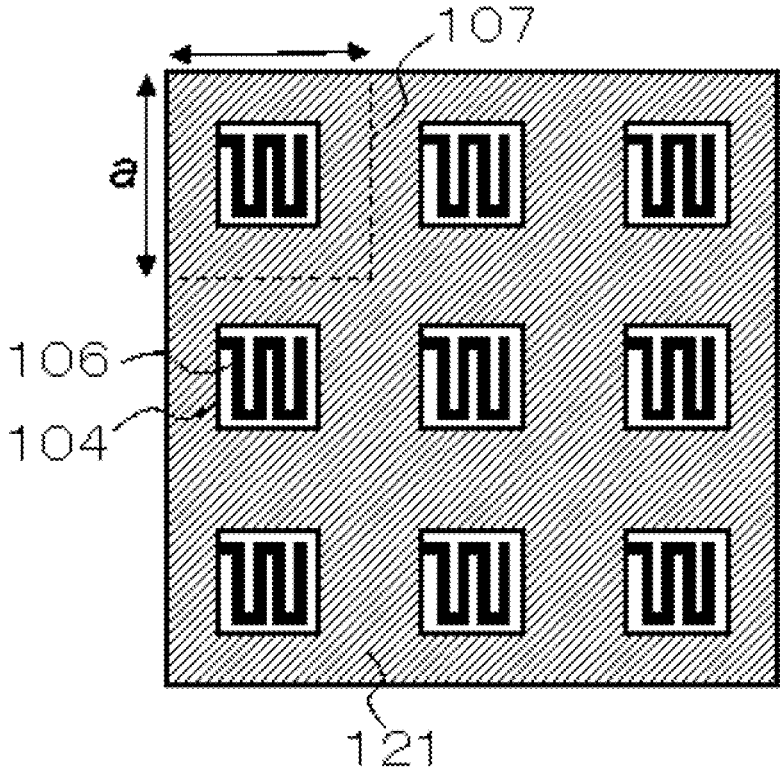

FIG. 14 is a diagram for explaining a modified example of the resonator antenna according to a third embodiment.

Figure 15:
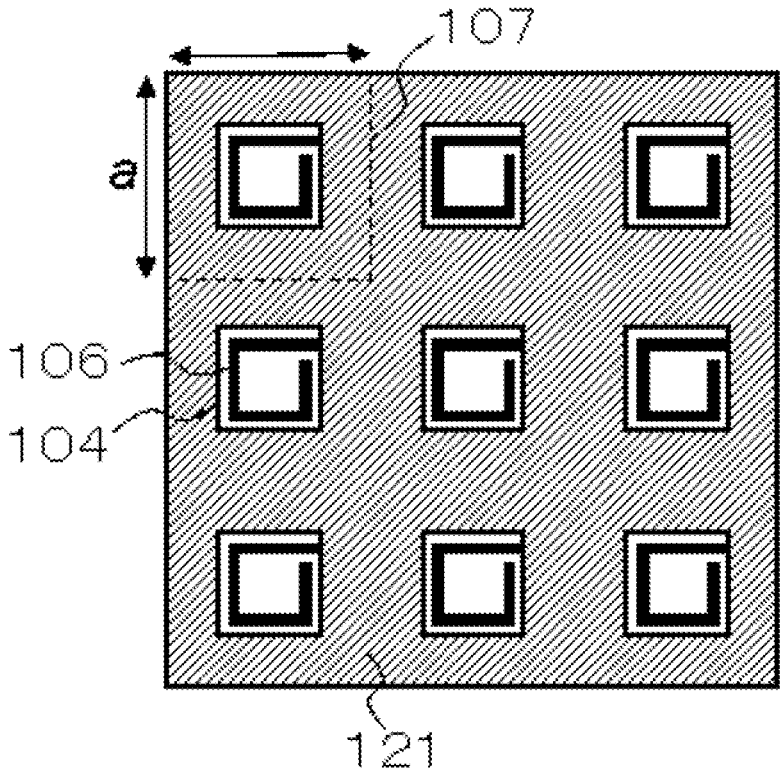

FIG. 15 is a diagram for explaining a modified example of the resonator antenna according to a third embodiment.

Figure 16:
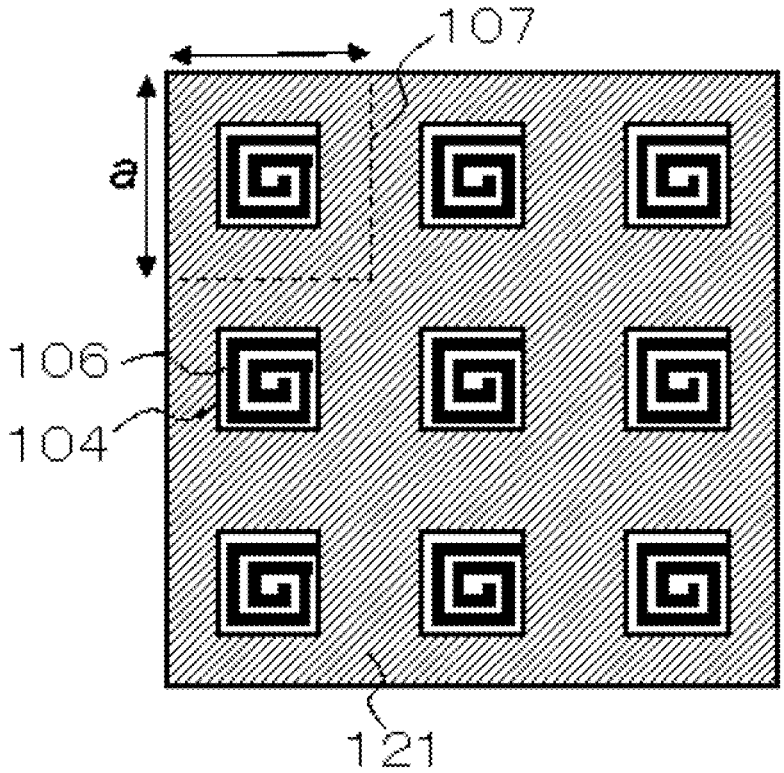

FIG. 16 is a diagram for explaining a modified example of the resonator antenna according to a third embodiment.

Figure 17:
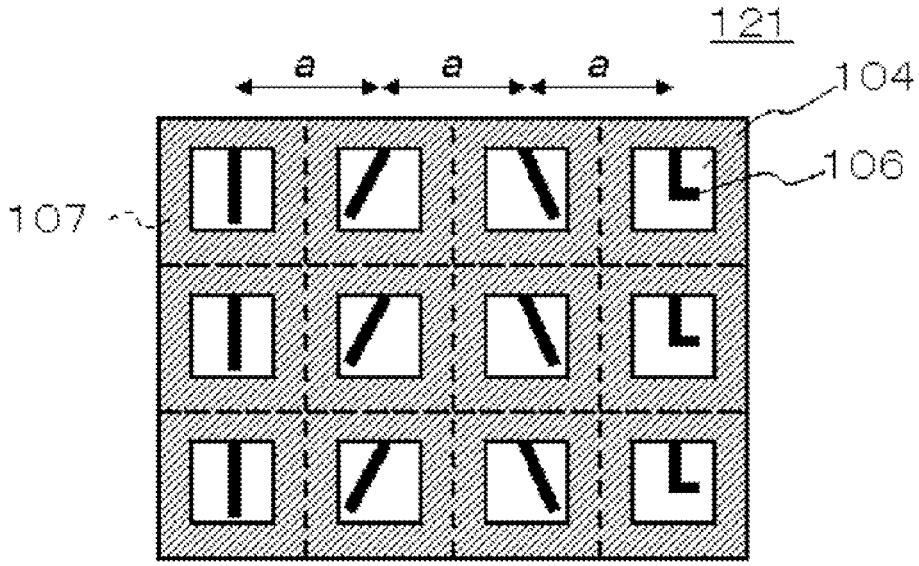

FIG. 17 is a diagram for explaining a modified example of the resonator antenna according to a third embodiment.

Figure 18:
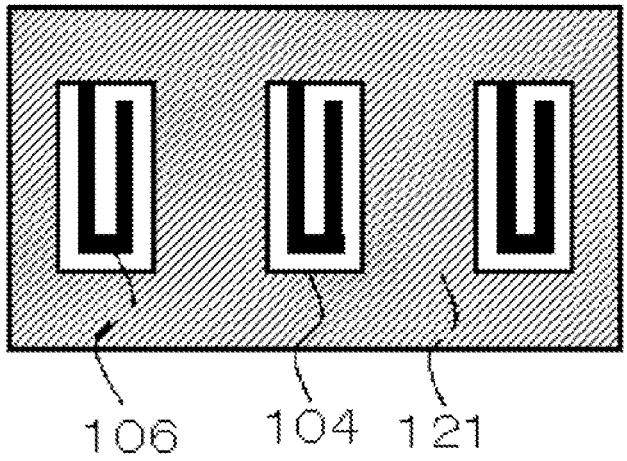

FIG. 18 is a diagram for explaining a modified example of the resonator antenna according to a third embodiment.

Figure 19:
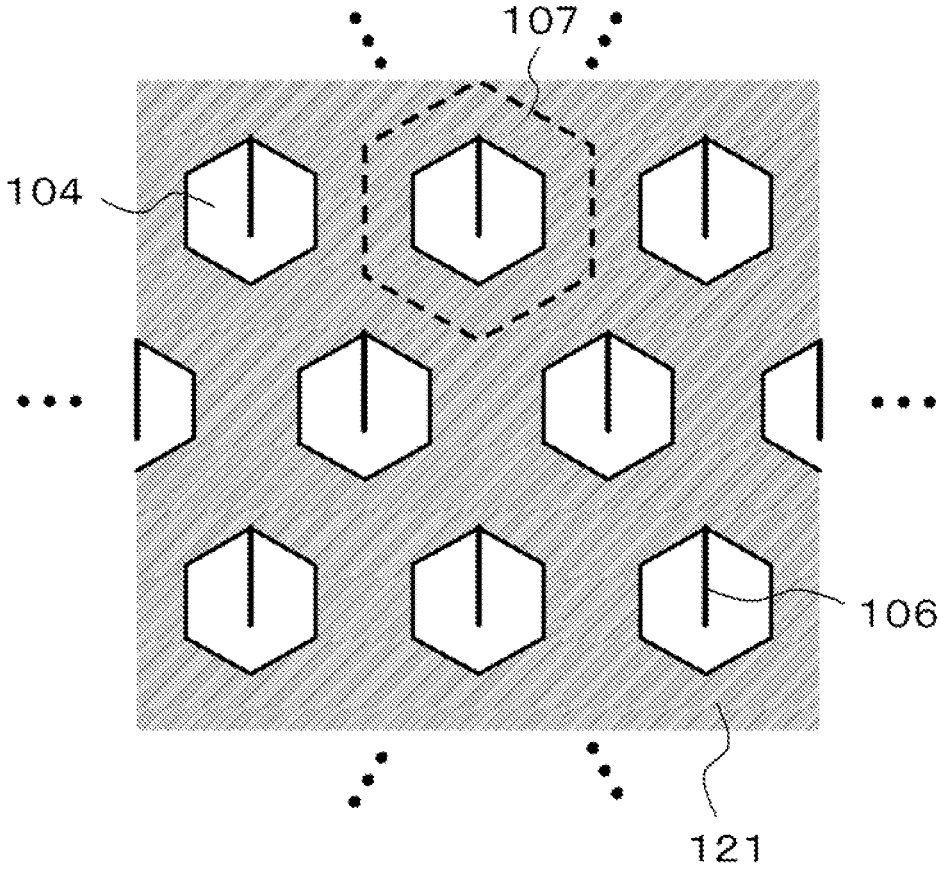

FIG. 19 is a diagram for explaining a modified example of the resonator antenna according to a third embodiment.

Figure 20:
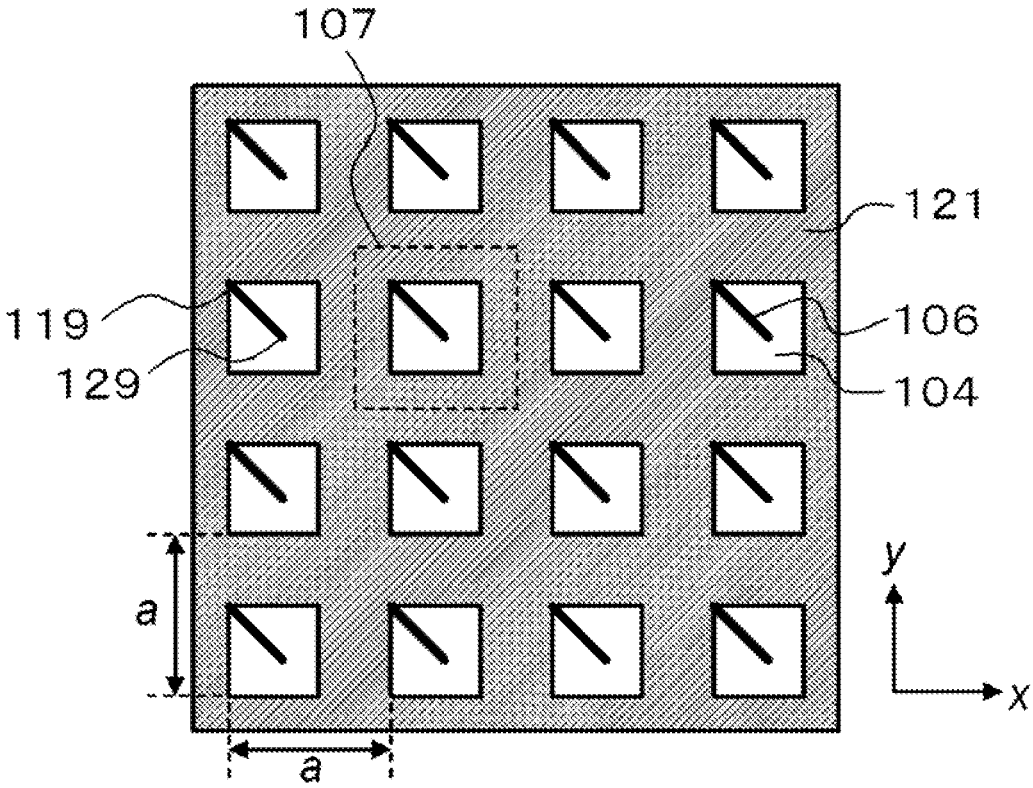

FIG. 20 is a diagram for explaining a modified example of the resonator antenna according to a third embodiment.

Figure 21:
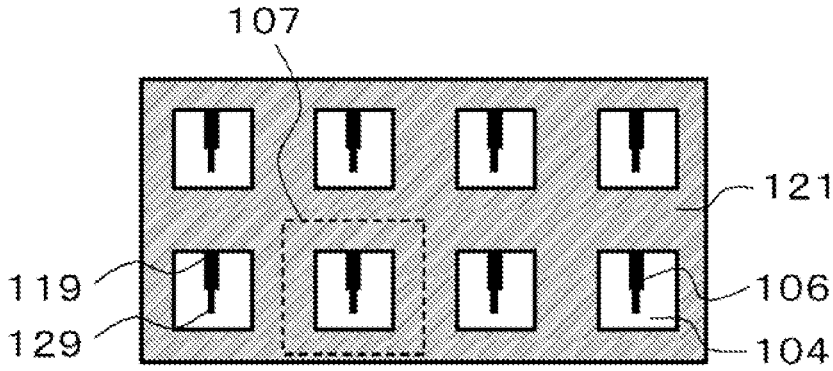
Figure 21:
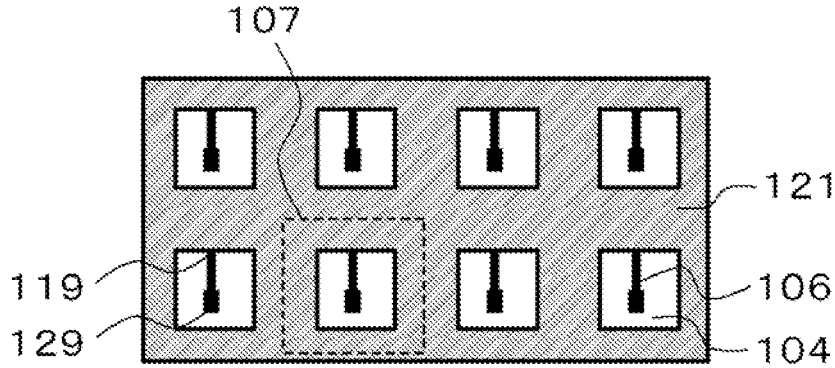

FIGS. 21 (*a-b*) are diagrams for explaining a modified example of the resonator antenna according to a third embodiment.

Figure 22:
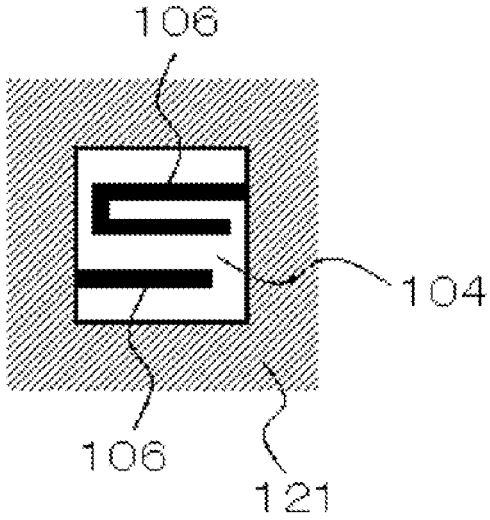
Figure 22:
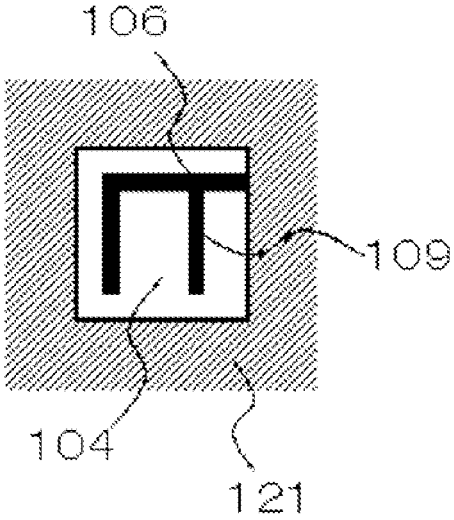

FIGS. 22 (*a-b*) are diagrams for explaining a modified example of the resonator antenna according to a third embodiment.

Figure 23:
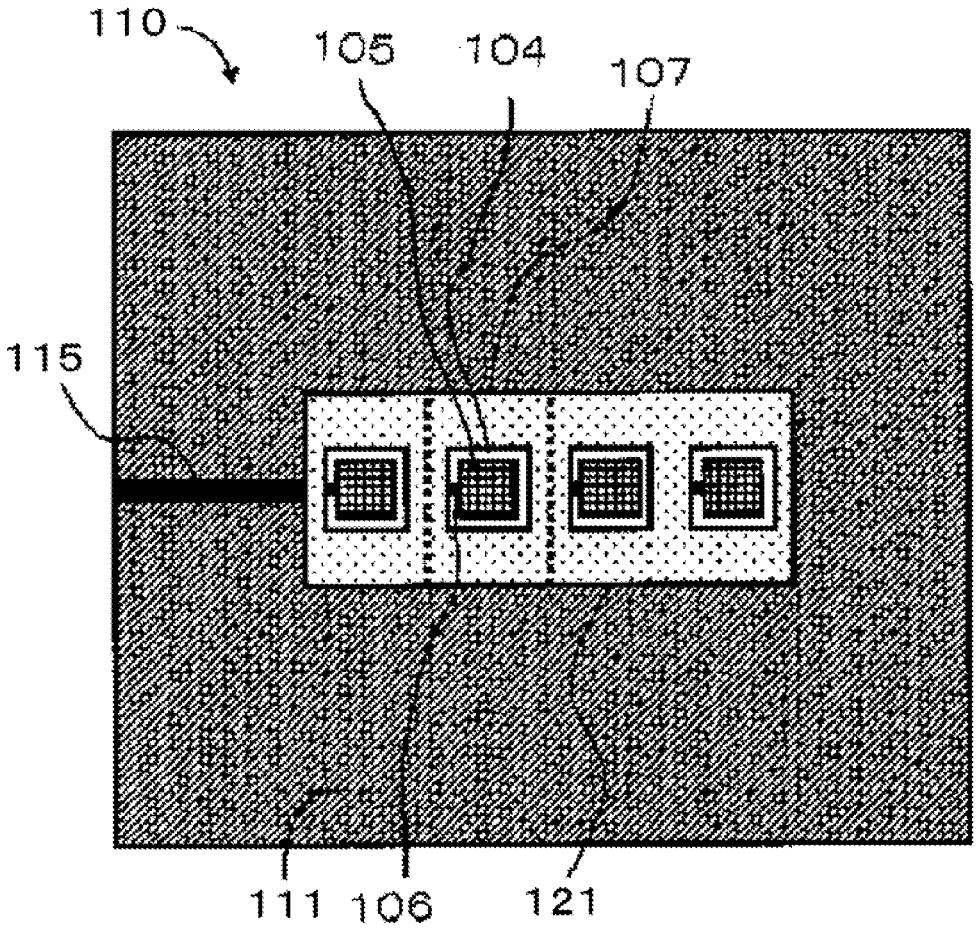

FIG. 23 is a plan view illustrating a configuration of the resonator antenna according to a fourth embodiment.

Figure 24:
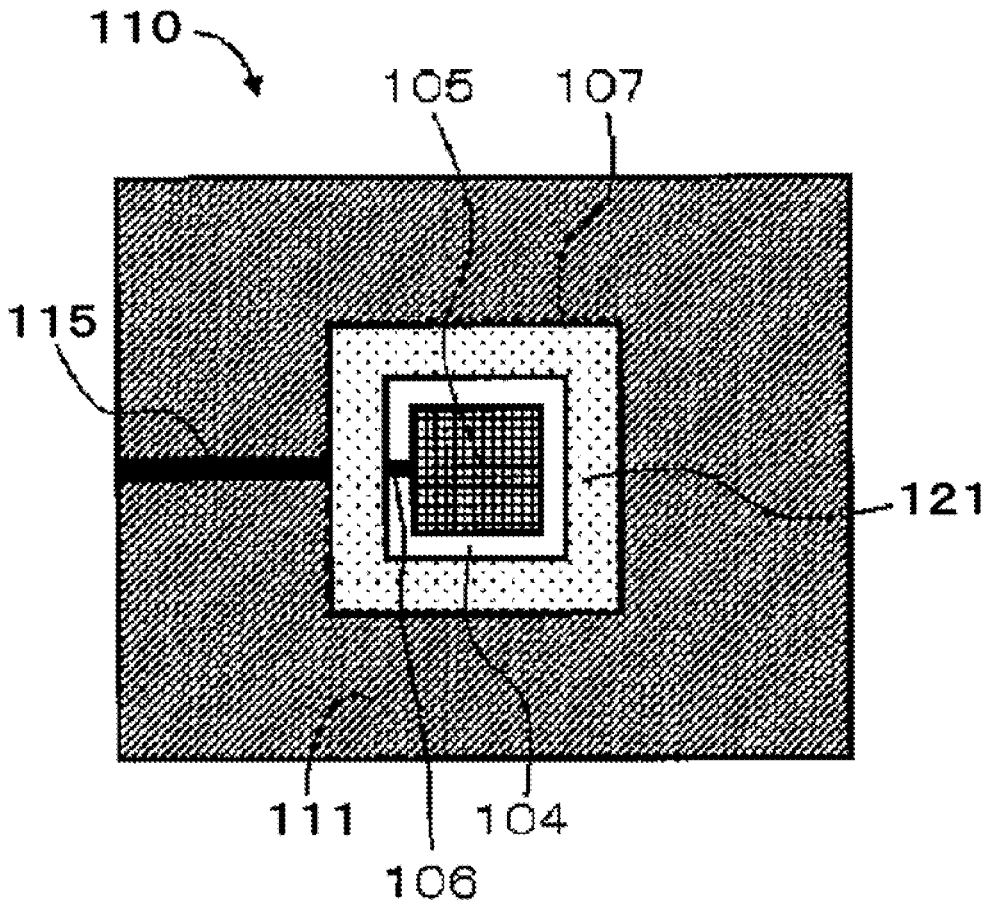

FIG. 24 is a plan view for explaining a modified example of the resonator antenna according to the fourth embodiment.

Figure 25:
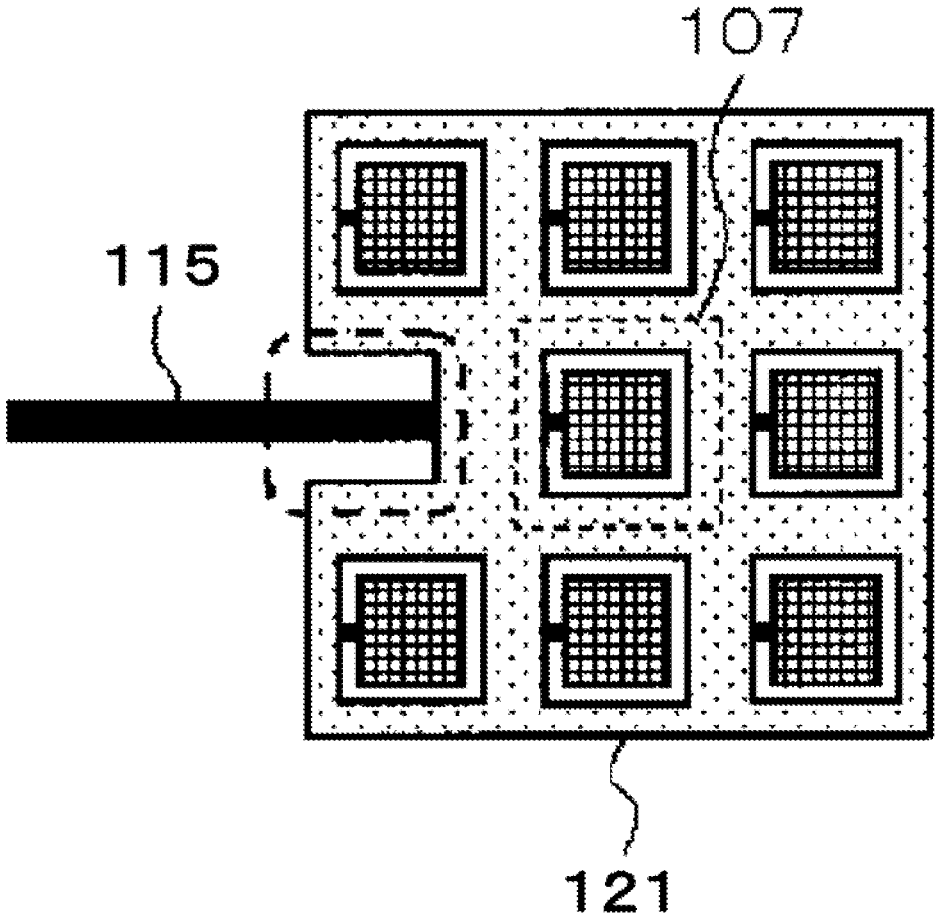

FIG. 25 is a diagram for explaining a configuration of the resonator antenna according to a fifth embodiment.

Figure 26:
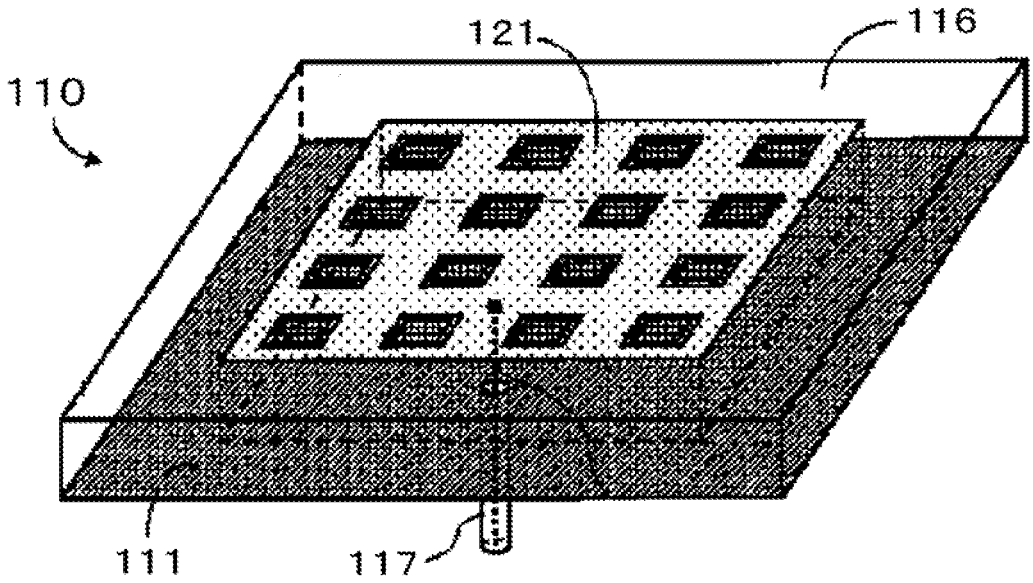

FIG. 26 is a diagram for explaining a configuration of the resonator antenna according to a sixth embodiment.

Figure 27:
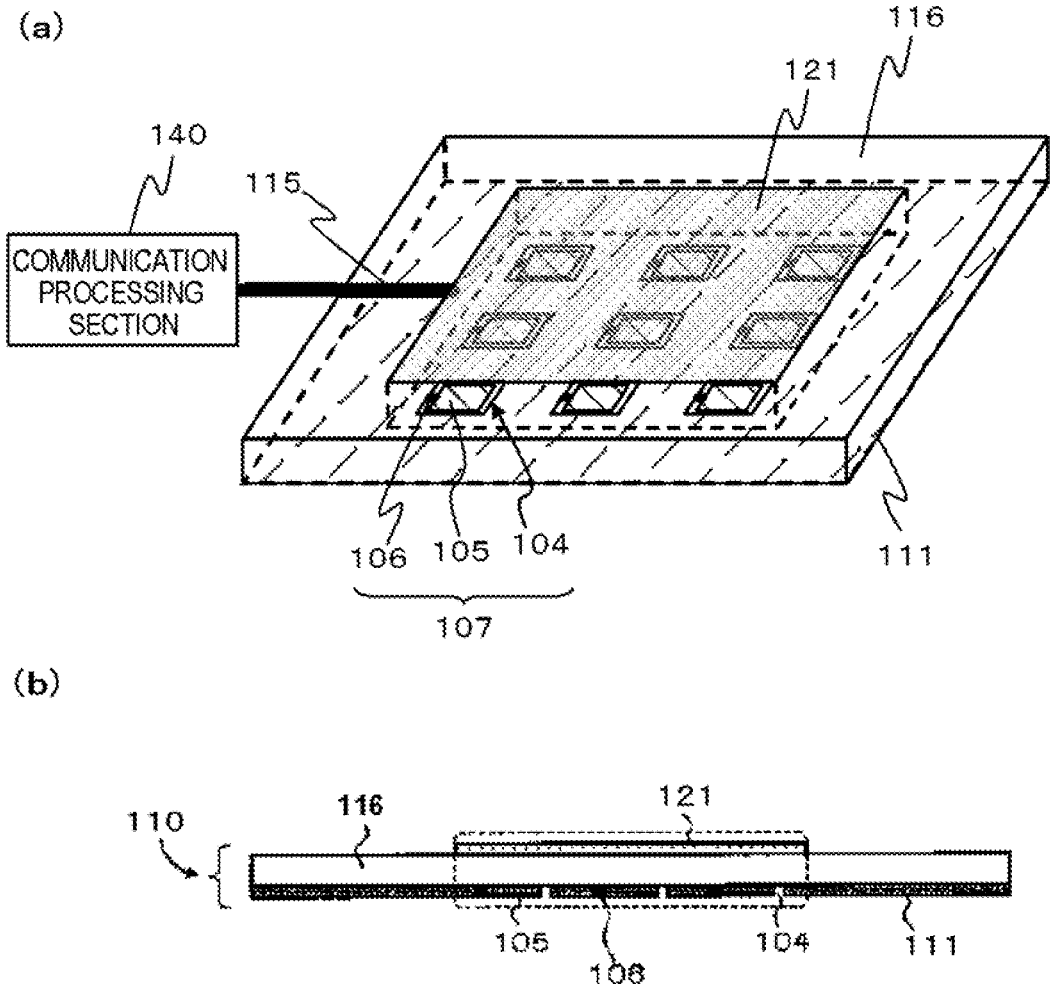

FIG. 27(*a*) is a perspective view illustrating a configuration of the resonator antenna according to a seventh embodiment, and FIG. 27(*b*) is a cross-sectional view illustrating the resonator antenna shown in FIG. 27(*a*).

Figure 28:
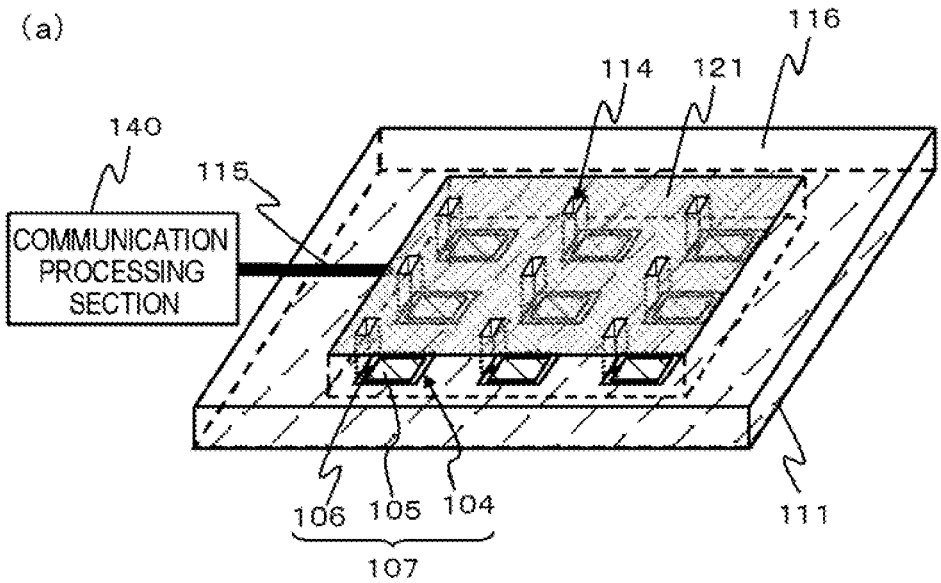
Figure 28:
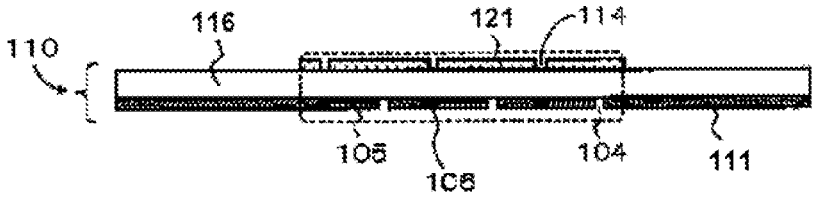

FIG. 28(*a*) is a perspective view illustrating a modified example of the resonator antenna shown in FIG. 27, and FIG. 28(*b*) is a cross-sectional view illustrating the resonator antenna shown in FIG. 28(*a*).

DESCRIPTION OF EMBODIMENTS

Hereinafter, embodiments of the invention will be described with reference to the accompanying drawings. In all the drawings, like elements are referenced by like reference numerals and descriptions thereof will not be repeated.

First Embodiment

Figure 1:
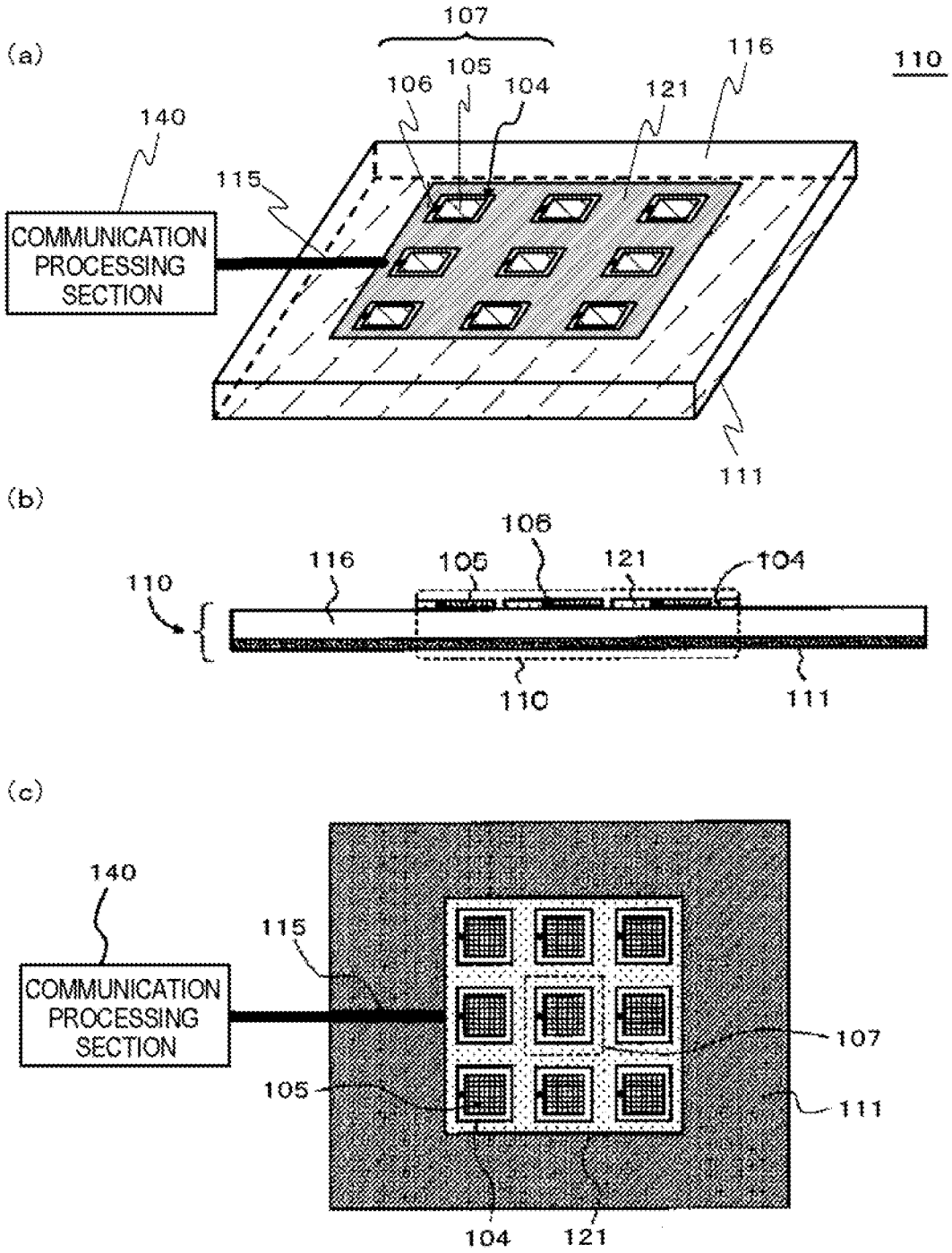
FIG. 1(*a*) is a perspective view illustrating a resonator antenna according to a first embodiment, FIG. 1(*b*) is a cross-sectional view illustrating the resonator antenna, and FIG. 1(*c*) is a plan view illustrating the resonator antenna.
Figure 2:
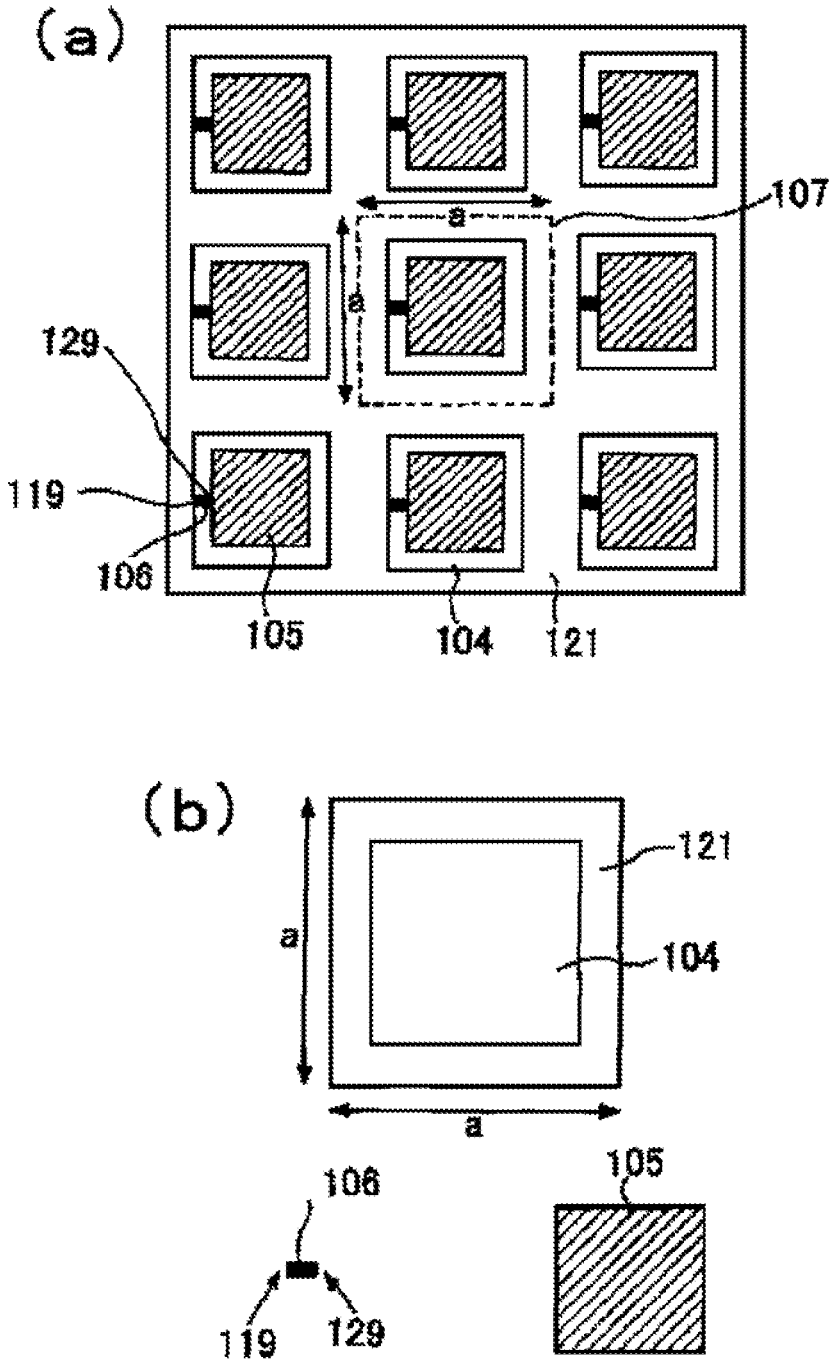
FIG. 2(*a*) is a plan view illustrating a layer in which a first conductor pattern used in the resonator antenna shown in FIG. 1 is formed, and FIG. 2(*b*) is an exploded view illustrating each configuration of the layer shown in FIG. 2(*a*).

FIG. 1(*a*) is a perspective view illustrating a resonator antenna 110 according to a first embodiment, FIG. 1(*b*) is a cross-sectional view illustrating the resonator antenna 110, and FIG. 1(*c*) is a plan view illustrating the resonator antenna 110. FIG. 2(*a*) is a plan view illustrating a layer in which a first conductor pattern 121 used in the resonator antenna 110 shown in FIG. 1 is formed, and FIG. 2(*b*) is an exploded view illustrating each configuration of the layer shown in FIG. 2(*a*).

The resonator antenna 110 is constituted by two conductor layers facing each other through a dielectric layer (for example, dielectric plate), and includes the first conductor pattern 121 serving as a first conductor, a second conductor pattern 111 serving as a second conductor, a plurality of first openings 104, a plurality of interconnects 106, and a power feed line 115. The first conductor pattern 121 has, for example, a sheet shape. The second conductor pattern 111 has, for example, a sheet shape, and is a pattern of which at least a portion (which, however, may be nearly the entirety thereof) faces the first conductor pattern 121. A plurality of first openings 104 is provided in the first conductor pattern 121. The interconnect 106 is provided in each of a plurality of first openings 104, and one end 119 thereof is connected to the first conductor pattern 121. The power feed line 115 is connected to the first conductor pattern 121. Unit cells 107 including the first opening 104 and the interconnect 106 are repeatedly, for example, periodically disposed. The unit cells 107 are repeatedly disposed, so that the portion other than the power feed line 115 of the resonator antenna 110 functions as a meta-material.

A dielectric layer 116 is located between a conductor layer in which the first conductor pattern 121 is formed and a conductor layer in which the second conductor pattern 111 is formed. The dielectric layer 116 is, for example, a dielectric plate such as an epoxy resin substrate or a ceramic substrate. In this case, the first conductor pattern 121, the interconnect 106, and the power feed line 115 are formed on a first surface of the dielectric plate, and the second conductor pattern 111 is formed on a second surface of the dielectric layer 116. When seen in a plan view, a region provided with the unit cell 107 is located at the inner side of the second conductor pattern 111 rather than the outer edge thereof. In addition, the first opening 104 is square or rectangular, and the first conductor pattern 121 is square or rectangular. The length of each side is an integral multiple of the arrangement period of the first openings 104.

Herein, when the "repeated" unit cells 107 are disposed, it is preferable that in the unit cells 107 adjacent to each other, the same via distance (center-to-center distance) is set so as to be within a range of the wavelength $\lambda$ of ½ of an electromagnetic wave assumed as noise. In addition, a case in which a portion of the configuration is missing in any of the unit cells 107 is also included in "repeated". In addition, when the unit cells 107 have a two-dimensional array, a case in which the unit cells 107 are partially missing is also included in "repeated". In addition, a case in which a portion of the components is out of alignment in some unit cells 107 or a case in which the arrangement of some unit cells 107 themselves is out of alignment is also included in "periodic". That is, even when periodicity in a strict sense breaks down, it is possible to obtain the characteristics as a meta-material in the case in which the unit cells 107 are repeatedly disposed, and thus a certain level of defects is allowed in "periodicity". Meanwhile, as causes for occurrence of the defects, a case of passing through the interconnects or the vias between the unit cells 107, a case in which the unit cells 107 cannot be disposed through the existing vias or patterns when the meta-material structure is added to the existing interconnect layout, a case in which manufacturing errors and the existing vias or patterns are used as a portion of the unit cells 107, and the like, may be considered.

The unit cell 107 of the resonator antenna 110 according to the embodiment further includes a third conductor pattern 105 as a third conductor. The third conductor pattern 105 is an island-shaped pattern provided in the first opening 104 separately from the first conductor pattern 121, and the other end 129 of the interconnect 106 is connected thereto. The unit cell 107 is constituted by the first conductor pattern 121, the first opening 104, the interconnect 106 and the third conductor pattern 105, and the rectangular space including each region facing them in the second conductor pattern 111.

In the embodiment, the unit cells 107 have a two-dimensional array. In more detail, the unit cell 107 is disposed at each lattice point of the square lattice of which the lattice constant is a. For this reason, a plurality of first openings 104 has the same center-to-center, distance. This is the same as examples shown in FIGS. 5(*a*) to 5(*d*), FIG. 6(*a*) and FIG. 6(*b*) described later. However, the unit cells 107 may have a one-dimensional array. A plurality of unit cells 107 has the same structure, and is disposed in the same direction. In the embodiment, the first opening 104 and the third conductor pattern 105 are square, and are disposed in the same direction so that the centers thereof overlap each other. The interconnect 106 is configured such that one end 119 is connected to the center of one side of the first opening 104, and is linearly extended at a right angle to this one side. The interconnect 106 functions as an inductance element.

In the embodiment, one side of the lattice formed by the arrangement of the unit cells 107 has an integral number of unit cells 107. In the example shown in FIG. 1, the unit cells 107 are arranged in a two-dimensional manner of 3×3. The power feed line 115 is connected to the unit cell 107 located at the center of this one side. A method of feeding power to the resonator antenna 110 using the power feed line 115 is the same as a power feeding method in a microstrip antenna. That is, the microstrip line is formed by the power feed line 115 and the second conductor pattern 111. Meanwhile, it is also possible to adopt another power feeding method. It is possible to form a communication apparatus by connecting the power feed line 115 to a communication processing section 140.

The capacitance C is generated between the third conductor pattern 105 and the second conductor pattern 111 by such a structure. In addition, the interconnect 106 (inductance L) as a plane-type inductance element is electrically connected between the third conductor pattern 105 and the first conductor pattern 121. For this reason, a structure is formed in which a serial resonance circuit 118 is shunted between the second conductor pattern 111 and the first conductor pattern 121, which results in a circuit configuration equivalent to a structure shown in FIG. 3.

Figure 4:
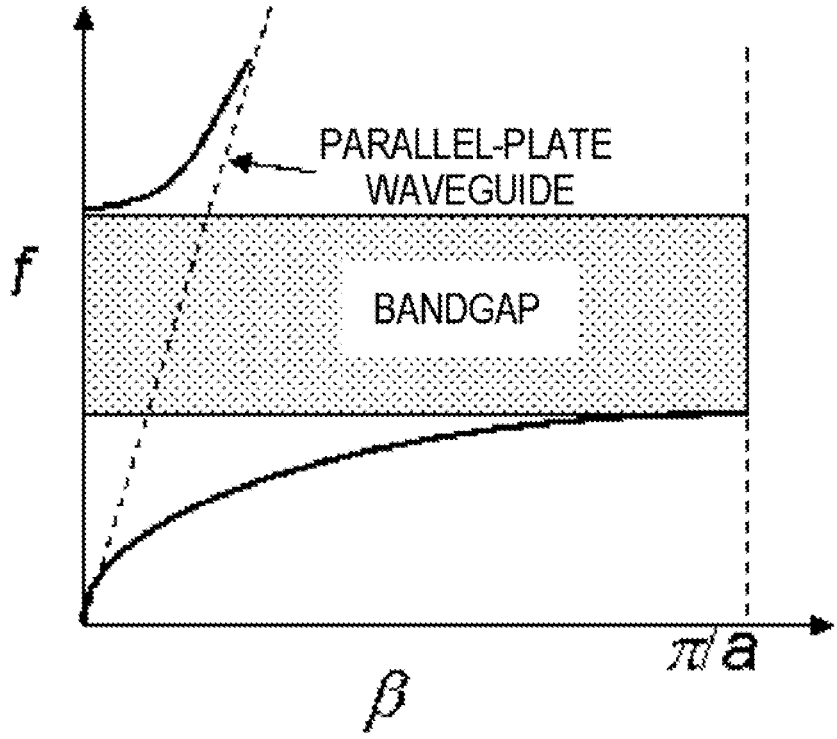
FIG. 4 is a graph illustrating a dispersion curve obtained by comparing electromagnetic wave propagation characteristics between a parallel-plate waveguide and a medium in which the infinite unit cells shown in FIG. 1 are periodically arranged.

FIG. 4 shows a dispersion curve obtained by comparing the electromagnetic wave propagation characteristics between a parallel-plate waveguide and a medium in which the infinite unit cells shown in FIG. 1 are periodically arranged. In FIG. 4, the solid lines show a dispersion relationship in the case where the infinite unit cells 107 are periodically arranged in the resonator antenna 110 shown in FIG. 1. In addition, the dashed line shows a dispersion relationship in the parallel-plate waveguide formed by replacing the first conductor pattern 121 in FIG. 1 by a conductor pattern in which the first opening 104 and the interconnect 106 do not exist.

In the case of the parallel-plate waveguide indicated by the dashed lines, the wave number and the frequency are expressed by the straight lines because they have a proportional relationship to each other, and the slope thereof is expressed by the following expression (1).

$$f/(\beta=c/(2\pi\cdot(\in_r\cdot\mu_r)^{1/2}) \quad (1)$$

On the other hand, in the case of the resonator antenna 110 shown in FIG. 1, as the frequency rises, the wave number rapidly increases compared to that of the parallel-plate waveguide indicated by the dashed line. When the wave number reaches n/a, a bandgap appears in the frequency band higher than this. When the frequency further rises, a passband appears again. With respect to the passband appearing at the lowest-frequency side, the phase velocity is lower than the phase velocity of the parallel-plate waveguide indicated by the dotted lines. For this reason, it is possible to miniaturize the resonator antenna 110.

Here, the frequency band of a stop band (bandgap) is determined by the series resonance frequency of the serial resonance circuit 118 depending on the inductance and the capacitance. When the series resonance frequency is attempted to be set to a certain specific value, the inductance drastically increases by providing the interconnect 106, and thus the capacitance can be suppressed to be small. Therefore, since the third conductor pattern 105 can be miniaturized, as a result, it is possible to reduce the lengths a of the opening 104 and the unit cell 107, and to miniaturize the resonator antenna 110.

Further, the series resonance frequency of the serial resonance circuit 118 is made low, whereby the bandgap shifts to the low-frequency side, and the phase velocity in the passband appearing at the lowest-frequency side is reduced.

In addition, in the resonator antenna 110, since the number of necessary conductor layers is two and the via is not used, it is possible to simplify and thin the structure, and to suppress the manufacturing costs. In addition, in the resonator antenna 110, since the interconnect 106 is used, it is possible to drastically increase the inductance compared to the case in which the inductance is formed through the via.

Figure 5:
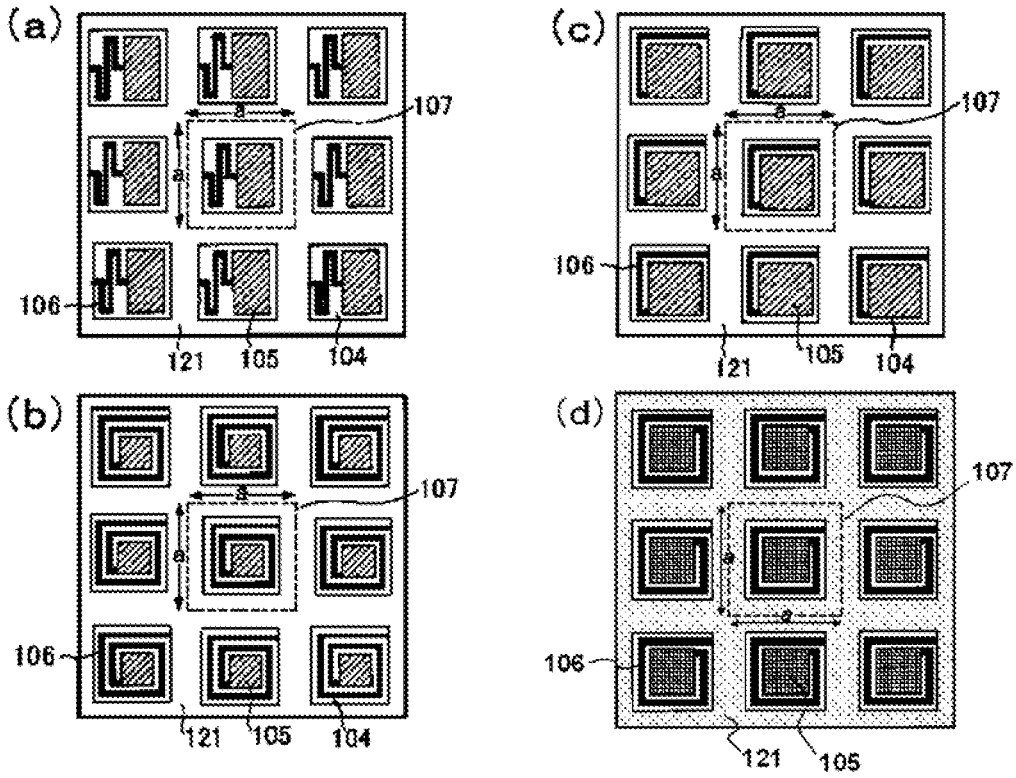
FIGS. 5 (*a-d*) are diagrams for explaining a modified example of FIG. 1.

Meanwhile, in the example of FIG. 2, since the interconnect 106 is linearly formed, the interconnect 106 may be formed in a meandering shape as shown in FIG. 5(*a*), and may be formed in a spiral shape as shown in FIG. 5(*b*). Further, as shown in FIGS. 5(*c*) and 5(*d*), the interconnect 106 may be formed in a broken line shape.

Although FIG. 2 shows an example in which one third conductor pattern 105 and one interconnect 106 are formed within each of the first openings 104, it is also possible to form two or more third conductor patterns 105 and interconnects 106 within each of the first openings 104. An example shown in FIG. 6(*a*) is a plan view illustrating a layout of the first conductor pattern 121 when two third conductor patterns 105 and two interconnects 106 are formed within the first opening 104. In the drawing, two sets of the third conductor patterns 105 and the interconnects 106 are disposed in the first opening 104 so as to be axisymmetric with each other. The first opening 104 is square, and two third conductor patterns 105 are rectangular. The sides of the first opening 104 and the third conductor pattern 105 are parallel to each other. Two third conductor patterns 105 are disposed axisymmetrically to each other with respect to the straight line which connects the center of the first opening 104 and the center of one side of the first opening 104. The interconnect 106 is configured such that one end 119 is linearly extended from the center of one side of the first opening 104 at a right angle to this one side, and the other end 129 is connected to the center of the long side of the third conductor pattern 105.

Figure 6:
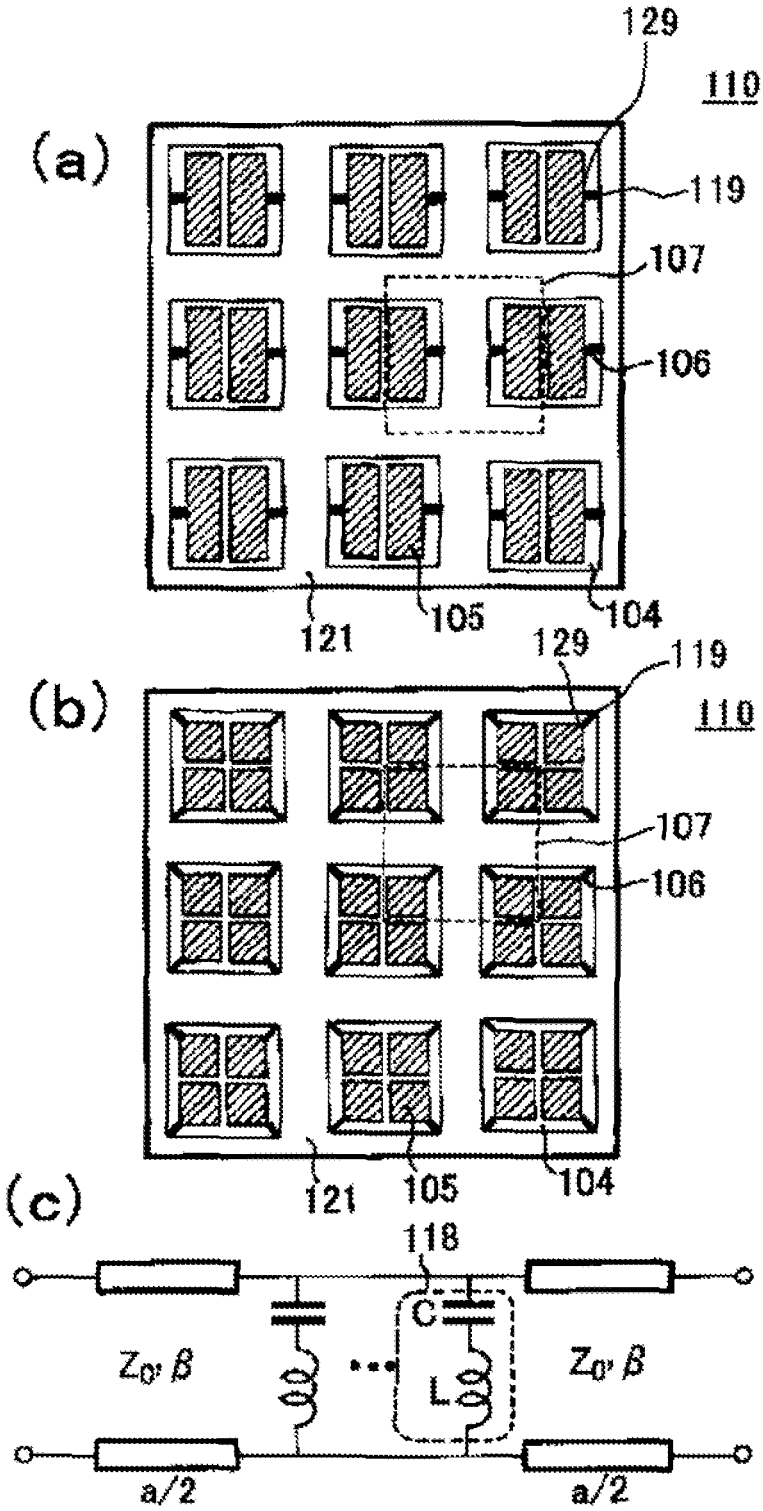
FIGS. 6 (*a-c*) are diagrams for explaining a modified example of FIG. 1.

In addition, an example shown in FIG. 6(*b*) is a plan view illustrating a layout of the first conductor pattern 121 when four third conductor patterns 105 and four interconnects 106 are formed within the first opening 104. In the drawing, four sets of the third conductor patterns 105 and the interconnects 106 are disposed in the first opening 104 at intervals of 90 degrees so as to be point-symmetrical with respect to the center of the first opening 104. The first opening 104 is square, and four third conductor patterns 105 are also square. The sides of the first opening 104 and the third conductor pattern 105 are parallel to each other. Four third conductor patterns 105 are disposed point-symmetrically with respect to the center of the first opening 104. The interconnect 106 is configured such that one end 119 is linearly extended in the direction of 45 degrees with respect to one side of the first opening 104 from the corner of the first opening 104, and the other end 129 is connected to the corner of the third conductor pattern 105.

In the resonator antenna 110 shown in FIGS. 6(*a*) and 6(*b*), the equivalent circuit per unit cell 107 is configured such that a plurality of serial resonance circuits 118 is connected in parallel as shown in FIG. 6(*c*).

Figure 3:
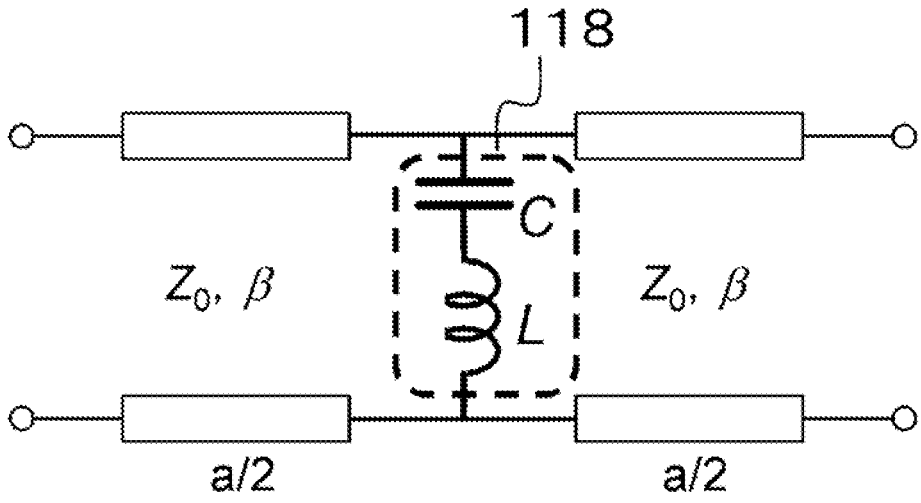
FIG. 3 is a diagram illustrating an equivalent circuit of a unit cell.

Here, when each of a plurality of serial resonance circuits 118 is equal to each other, the serial resonance circuits are equivalent to the circuit shown in FIG. 3, and thus the same characteristics as those in the case where one third conductor pattern 105 and one interconnect 106 are formed within each of the first openings 104 are obtained. On the other hand, when each of a plurality of serial resonance circuits 118 connected in parallel is made different from each other, it is possible to cause the stop band to be wide-banded, or to be multi-banded.

Meanwhile, although FIG. 2(*a*) shows an example in which the first opening 104 having a square shape is periodically arranged in a square lattice shape, the layout of the first opening 104 is not limited to the square of FIG. 2(*a*). For example, the first opening 104 having a square shape may be formed in a polygonal shape such as a regular hexagon or may be also formed in a circular shape. In addition, the first opening 104 may be disposed in a triangular lattice shape.

Next, one example of a method of manufacturing the resonator antenna 110 will be described. First, a conductive film is formed on both sides of a sheet-shaped dielectric layer. A mask pattern is formed on one conductive film, and the conductive film is etched using this mask pattern as a mask. Thereby, the conductive film is selectively removed, and the first conductor pattern 121, a plurality of first openings 104, a plurality of interconnects 106, and the power feed line 115 are integrally formed. In addition, the other conductive film can be used as the second conductor pattern 111 as it is.

In addition, the resonator antenna 110 can also be manufactured by sequentially forming the first conductor pattern 121, a dielectric film such as a silicon oxide film, and the second conductor pattern 111 on a glass substrate or a silicon, substrate and the like using a thin-film process. Alternatively, the space between which the layers of the second conductor pattern 111 and the first conductor pattern 121 are opposing may be provided with nothing (may be provided with air).

Second Embodiment

FIG. 7(*a*) is a perspective view illustrating the resonator antenna 110 according to a second embodiment, and FIG. 7(*b*) is a cross-sectional view illustrating a configuration of the resonator antenna 110 shown in FIG. 7(*a*). The resonator antenna 110 according to the embodiment has the same configuration as that of the resonator antenna 110 according to the first embodiment except that the second conductor pattern 111 includes a plurality of second openings 114. The second openings 114 overlap each of a plurality of interconnects 106 when seen in a plan view. Since the interlinkage magnetic flux between the interconnect 106 and the second conductor pattern 111 increases by providing the second opening 114, this causes the inductance per unit length of the interconnect 106 to be increased. In addition, the second opening 114 is square or rectangular. The first conductor pattern 121 is square or rectangular, and the length of each side is an integral multiple of the arrangement period of the first openings 104.

FIG. 8(*a*) is a plan view of the second conductor pattern 111 of the resonator antenna 110 shown in FIG. 7(*a*). The second opening 114 is periodically arranged in the second conductor pattern 111. The period of the second opening 114 is a, and is equal to the length of one side of the unit cell 107 and the period of the first opening 104.

FIG. 8(*b*) is a plan view when the unit cell 107 of the resonator antenna 110 shown in FIG. 7(*a*) is seen through the upper surface, and FIG. 8(*c*) is a perspective view illustrating the unit cell 107. In these drawings, the interconnect 106 is entirely located in the second opening 114 when seen in a plan view. Thereby, it is possible to increase the inductance per unit length of the interconnect 106. Therefore, since the interconnect 106 can be made small in the design as a desired inductance value, it is possible to reduce the area occupied by the interconnect 106, and to miniaturize the unit cell 107 as a result.

Although FIG. 8(*b*) shows an example in which the entire interconnect 106 is included in the second opening 114 when the unit cell 107 is seen through the upper surface, a portion of the interconnect 106 can also be designed so as to be located in the second opening 114 when seen in a plan view. FIGS. 9(*a*) and 9(*b*) are plan views illustrating an example in which a portion of the interconnect 106 is included in the second opening 114 when the unit cell 107 is seen through the upper surface. Such a structure is effective when both of the miniaturization of the second opening 114 and the increase in the inductance are achieved.

Meanwhile, in each of the examples shown in the first and second embodiments, as shown in a plan view of FIG. 10(*a*) and a cross-sectional view of FIG. 10(*b*), a chip inductor 500 may be used in place of the interconnect 106.

Third Embodiment

FIG. 11 is a perspective view illustrating the resonator antenna 110 according to a third embodiment, but the power feed line 115 is not shown herein. FIG. 12(*a*) is a cross-sectional view illustrating the resonator antenna 110 shown in FIG. 11, and FIG. 12(*b*) is a plan view illustrating a layer provided with the first conductor pattern 121. This resonator antenna 110 has the same configuration as that of the resonator antenna 110 according to the first embodiment, except that the third conductor pattern 105 is not included and the other end 129 of the interconnect 106 is an open end. In the embodiment, the interconnect 106 functions as an open stub, and the portion facing the interconnect 106 in the second conductor pattern 111 and the interconnect 106 form a transmission line 101, for example, a microstrip line. A method of manufacturing the resonator antenna 110 according to the embodiment is the same as that of the first embodiment.

In the example shown in the drawings, the unit cell 107 including the first opening 104 and the interconnect 106, and a region facing them in the second conductor pattern 111 is formed. In the example shown in FIGS. 11 and 12, the unit cell 107 has a two-dimensional array when seen in a plan view. In more detail, the unit cell 107 is disposed at each lattice point of the square lattice having a lattice constant of a. For this reason, a plurality of first openings 104 is disposed so that the center-to-center distances are equal to each other.

A plurality of unit cells 107 has the same structure, and is disposed in the same direction. In the embodiment, the first opening 104 is square. The interconnect 106 is linearly extended from the center of one side of the first opening 104 at a right angle to this one side.

FIG. 13(*a*) is an equivalent circuit diagram of the unit cell 107 shown in FIG. 12. As shown in the drawing, the parasitic capacitance $C_R$ is formed between the first conductor pattern 121 and the second conductor pattern 111. In addition, the inductance $L_R$ is formed in the first conductor pattern 121. In the example shown in the drawing, since the first conductor pattern 121 is bisected by the first opening 104 when seen from the unit cell 107 and the interconnect 106 is disposed at the center of the first opening 104, the inductance $L_R$ is also bisected centering on the interconnect 106.

In addition, as mentioned above, the interconnect 106 functions as an open stub, and the portion facing the interconnect 106 in the second conductor pattern 111 and the interconnect 106 form the transmission line 101, for example, the microstrip line. The other end of the transmission line 101 is an open end.

FIG. 13(*b*) is an equivalent circuit diagram of the unit cell 107 when the unit cell 107 shown in FIG. 12 is shifted by a half cycle of a/2 in the x direction in FIG. 12. In the example shown in the drawing, since a method of taking the unit cell 107 is different, the inductance $L_R$ is not divided by the interconnect 106. However, since a plurality of unit cells 107 is periodically disposed, the characteristics of the resonator antenna 110 shown in FIG. 11 do not change depending on the difference in the method of taking of the unit cell 107.

The characteristics of electromagnetic waves propagating through the resonator antenna 110 are determined by the series impedance Z based on the inductance $L_R$, and the admittance based on the transmission line 101 and the parasitic capacitance $C_R$.

In the equivalent circuit diagram of the unit cell 107 shown in FIGS. 13(*a*) and 13(*b*), the bandgap is shifted to the low-frequency side by making the line length of the transmission line 101 longer. Generally, although the bandgap band is shifted to the high-frequency side when the unit cell 107 is miniaturized, it is possible to miniaturize the unit cell 107 without changing the lower limit frequency of the bandgap by making the line length of the transmission line 101 longer.

In addition, the line length of the transmission line 101 is made longer, whereby the phase velocity in the passband appearing at the lowest-frequency side is also reduced with the shift of the bandgap to the low-frequency side. In the passband appearing at this lowest-frequency side, when the frequency is the same, the condition is satisfied in which the wave number of electromagnetic waves propagating through the medium in which the infinite unit cells 107 shown in FIG. 12 are periodically arranged becomes larger than the wave number of electromagnetic waves in the parallel-plate waveguide. For this reason, the wavelength of an electromagnetic wave in the resonator antenna 110 shown in FIG. 11 becomes shorter than the wavelength of an electromagnetic wave in the parallel-plate waveguide. That is, it is possible to miniaturize the resonator by using the resonator antenna 110 shown in FIG. 11.

Here, the admittance Y is determined from the input admittance and the capacitance $C_R$ of the transmission line 101. The input admittance of the transmission line 101 is determined by the line length of the transmission line 101 (that is, the length of the interconnect 106) and the effective dielectric constant of the transmission line 101. The input admittance of the transmission line 101 in a certain frequency becomes capacitive or inductive depending on the line length and the effective dielectric constant of the transmission line 101. Generally, the effective dielectric constant of the transmission line 101 is determined by a dielectric material constituting the waveguide. On the other hand, a degree of freedom exists in the line length of the transmission line 101, and thus it is possible to design the line length of the transmission line 101 so that the admittance Y becomes inductive in a desired band. In this case, the resonator antenna 110 shown in FIG. 11 behaves so as to have a bandgap in the above-mentioned desired band.

Therefore, in order to implement the structure described in the equivalent circuit shown in FIG. 13(*a*) or 13(*b*), it may simply be that the line lengths of the interconnect 106 within each of the first openings 104 are equal to each other, the connection portions between one end 119 of the interconnect 106 and the first conductor pattern 121 are repeatedly, for example periodically disposed, and the positions of one end 119 are the same in each of the unit cells 107.

Meanwhile, the line length of the transmission line 101, that is, the length of the interconnect 106 can be adjusted by appropriately changing the extended shape of the interconnect 106. For example, in the example shown in FIG. 14, the interconnect 106 is extended so as to form a meander. In the example shown in FIG. 15, the interconnect 106 is extended so as to form a loop along the edge of the first opening 104. In the example shown in FIG. 16, the interconnect 106 is extended so as to form a spiral.

In addition, as shown in FIG. 11, FIG. 12, and FIGS. 14 to 16, when the shape, the size, and the direction of the interconnect 106 within the first opening 104 all have a periodic array with the same unit structure, the design is easily made. However, as shown in a modified example of FIG. 17, at least one of a plurality of interconnects 106 may be different from the others. In FIG. 17, the shapes of the interconnect 106 are different from each other, and one among them is a broken line shape. However, the lengths of the interconnect 106 are equal to each other. In addition, since the positions of one end 119 of the interconnect 106 are the same in each of the unit cells 107, the positions of one end 119 maintain periodicity.

In addition, the first opening 104 is not required to be square, and may have another polygonal shape. For example, the first opening 104 may be rectangular as shown in FIG. 18, and may be regular hexagonal as shown in FIG. 19. In the example shown in FIG. 19, the interconnect 106 is extended in the direction of 60 degrees with respect to the side of the first opening 104 from the corner of the first opening 104.

In addition, as shown in FIG. 20, one end 119 of the interconnect 106 may be connected to the corner of the first opening 104 having a square shape. In the example shown in the drawing, the interconnect 106 is extended in the direction of 45 degrees with respect to the side of the first opening 104 from the corner of the first opening 104.

In addition, as shown in FIG. 21, the interconnect 106 may vary in width along the way. For example, in the example shown in FIG. 21(*a*), one end 119 connected to the first conductor pattern 121 after the interconnect 106 is larger in width than the other end 129 which is an open end. In addition, in the example shown in FIG. 21(*b*), one end 119 is smaller in width than the other end 129.

In addition, as shown in FIG. 22(*a*), a plurality of interconnects 106 may be included within the first opening 104. In this case, it is preferable that the interconnects 106 located within the same first opening 104 are different from each other in length. In addition, as shown in FIG. 22(*b*), a branch interconnect 109 branching off from the interconnect 106 may be included within the first opening 104. In this case, it is preferable that the length from one end of the interconnect 106 to the open end of the branch interconnect 109 and the length of the interconnect 106 are different from each other. Meanwhile, even in any of FIGS. 22(*a*) and 22(*b*), it is preferable that the unit cells 107 have the same configuration, and are directed to the same direction.

Meanwhile, in each of the examples mentioned above, the shapes of a plurality of the first openings 104 may be different from each other. However, the positions of one end 119 of the interconnect 106 are required to have periodicity.

As mentioned above, according to the embodiment, it is possible to provide the resonator antenna 110 capable of being formed by two conductor layers and miniaturizing the unit cell 107, without requiring a via.

In addition, as shown in FIG. 22, when a plurality of interconnects 106 which are different in length is provided within the first opening 104 or the branch interconnect 109 is provided therewithin, the equivalent circuit of the unit cell 107 includes a plurality of transmission paths, which are different in length, in parallel. For this reason, since the resonator antenna 110 includes a bandgap in the frequency band corresponding to the length of each of the transmission paths, it is possible to include a plurality of bandgaps (multi-banding).

Fourth Embodiment

FIG. 23 is a plan view illustrating a configuration of the resonator antenna 110 according to a fourth embodiment. In the embodiment, the resonator antenna 110 has the same configuration as that of the resonator antenna 110 shown in any of the first to third embodiments, except that the unit cell 107 is linearly arranged in a one-dimensional manner. Meanwhile, FIG. 23 shows a case in which the configuration of the unit cell 107 is the same as that of the first embodiment.

Meanwhile, as shown in FIG. 24, the resonator antenna 110 may include only one unit cell 107.

It is possible to obtain the same effect as that of any of the first to third embodiments even in the embodiment.

Fifth Embodiment

FIG. 25 is a diagram for explaining a configuration of the resonator antenna 110 according to a fifth embodiment. The resonator antenna 110 according to the embodiment is the same as that of any of the first to third embodiments except for the following respects. Meanwhile, FIG. 25 shows the same case as that of the first embodiment.

First, the lattice showing the arrangement of the unit cell 107 has a lattice defect. This lattice defect is located at the center of the side to which the power feed line 115 is connected in the lattice. The power feed line 115 is extended into the lattice defect, and is connected to the unit cell 107 located at the inner side from the outermost circumference.

It is possible to obtain the same effect as any of the first to third embodiments even in the embodiment. In addition, it is possible to adjust the impedance of the resonator antenna 110 by adjusting the position and number of lattice defects. For this reason, it is possible to improve the radiation efficiency of the resonator antenna 110 by matching the impedance of the power feed line 115 with the impedance of the resonator antenna 110.

Sixth Embodiment

FIG. 26 is a diagram for explaining a configuration of the resonator antenna 110 according to a sixth embodiment. The resonator antenna 110 according to the embodiment is the same as that of any of the first to third embodiments except for a power feeding method. Meanwhile, FIG. 26 shows the case as that of the first embodiment.

In the embodiment, the power feed line 115 is not provided, and a coaxial cable 117 is provided instead thereof. The coaxial cable 117 is connected to a surface provided with the second conductor pattern 111 in the resonator antenna 110. In detail, the second conductor pattern 111 is provided with an opening, and the coaxial cable 117 is installed in this opening. An internal conductor of the coaxial cable 117 is connected to the first conductor pattern 121 through a through via provided in a region overlapping the opening. In addition, an external conductor of the coaxial cable 117 is connected to the second conductor pattern 111.

It is possible to obtain the same effect as that of any of the first to third embodiments even in the embodiment. In addition, it is possible to feed power to the resonator antenna 110 using the coaxial cable 117 having a high versatility.

Seventh Embodiment

FIG. 27(*a*) is a perspective view, illustrating a configuration of the resonator antenna 110 according to a seventh embodiment, and FIG. 27(*b*) is a cross-sectional view illustrating the resonator antenna 110 shown in FIG. 27(*a*). The resonator antenna 110 according to the embodiment is the same as that of any of the first to sixth embodiments, except that the first opening 104, the third conductor pattern 105, and the interconnect 106 are formed not in the first conductor pattern 121 but in the second conductor pattern 111. FIG. 27 shows the same case as that of the first embodiment.

FIG. 28(*a*) is a perspective view illustrating a modified example of the resonator antenna 110 shown in FIG. 27(*a*), and FIG. 28(*b*) is a cross-sectional view illustrating the resonator antenna 110 shown in FIG. 28(*a*). The resonator antenna 110 according to the modified example has the same configuration as that of the resonator antenna 110 shown in FIG. 27(*a*), except that the first conductor pattern 121 is provided with the second opening 114. The configuration of the second opening 114 is the same as that of the second embodiment.

The resonator antenna 110 according to the embodiment is the same as that of any of the first to sixth embodiments with the inclusion of the equivalent circuit, except that the layer structure is turned upside down. For this reason, it is possible to obtain the same effect as any of the first to sixth embodiments.

As described above, although the embodiments of the invention have been set forth with reference to the drawings, they are merely illustrative of the invention, and various configurations other than those stated above can be adopted.

The application is based on Japanese Patent Application No. 2009-54007 filed on Mar. 6, 2009, the content of which is incorporated herein by reference.

The invention claimed is:

1. A resonator antenna comprising:

a first conductor;

a second conductor of which at least a portion faces the first conductor;

a plurality of first openings provided in the first conductor;

a plurality of interconnects, provided in respective ones of the first openings, each interconnect having one end that is connected to the first conductor; and a power feed line connected to the first conductor or the second conductor, wherein the first conductor and the second conductor are electrically connected without using a connecting member, and wherein unit cells including the first opening and the interconnect are repeatedly arranged.

2. The resonator antenna according to claim 1, wherein the other end of the interconnect is an open end.

3. The resonator antenna according to claim 2, wherein the interconnect, the first opening, and the first conductor are integrally formed.

4. The resonator antenna according to claim 2, wherein the interconnect and the portion facing the interconnect in the second conductor form a transmission line.

5. The resonator antenna according to claim 4, wherein the transmission line is a microstrip line.

6. The resonator antenna according to claim 1, further comprising a branch interconnect which is located within the first opening and branches off from the interconnect.

7. The resonator antenna according to claim 1, further comprising a third conductor having an island shape, provided in the first opening separately from the first conductor, to which the other end of the interconnect is connected.

8. The resonator antenna according to claim 7, wherein the first conductor, the first opening, the interconnect, and the third conductor are integrally formed.

9. The resonator antenna according to claim 7, wherein a plurality of the third conductors is included within the first opening, and the interconnect is included for each of the plurality of the third conductors.

10. The resonator antenna according to claim 7, further comprising a second opening, provided in the second conductor, which overlaps the interconnect when seen in a plan view.

11. The resonator antenna according to claim 1, wherein the first opening and the interconnect are plurally provided, and wherein unit cells including the first opening and the interconnect are repeatedly arranged.

12. The resonator antenna according to claim 11, wherein the lengths of the plurality of interconnects are equal to each other.

13. The resonator antenna according to claim 11, wherein the one end of the plurality of interconnects has a periodic array.

14. The resonator antenna according to claim 11, wherein the plurality of the first openings has the same shape and is directed to the same direction, and is periodically disposed.

15. The resonator antenna according to claim 14, wherein the unit cells have the same configuration, and are directed to the same direction.

16. The resonator antenna according to claim 11, wherein the first opening is square or rectangular, and wherein any one of the first conductor and the second conductor is square or rectangular, and the length of each side is an integral multiple of the arrangement period of the first opening.

17. The resonator antenna according to claim 11, wherein the plurality of unit cells has a two-dimensional array.

18. The resonator antenna according to claim 11, wherein the plurality of unit cells has a one-dimensional array.

19. The resonator antenna according to claim 1, wherein the interconnect is extended in a linear shape or a broken line shape.

20. The resonator antenna according to claim 1, wherein the interconnect is extended so as to form a meander, a loop, or a spiral.

21. The resonator antenna according to claim 1, wherein the opening has a polygonal shape.

22. A resonator antenna comprising:

a first conductor;

a second conductor of which at least a portion faces the first conductor;

a plurality of first openings provided in the first conductor;

a plurality of third conductors, each third conductor having an island shape and provided in a respective one of the first openings separately from the first conductor;

a chip inductor, provided in the third conductor, which connects the third conductor to the first conductor; and a power feed line connected to the first conductor or the second conductor, wherein the first conductor and the second conductor are electrically connected without using a connecting member, and wherein unit cells including the first opening and the third conductors are repeatedly arranged.

23. A communication apparatus comprising:

a resonator antenna; and a communication processing section connected to the resonator antenna, wherein the resonator antenna includes a first conductor, a second conductor of which at least a portion faces the first conductor, a plurality of first openings provided in the first conductor, a plurality of interconnects, provided in respective ones of the first openings, each interconnecting having one end that is connected to the first conductor, and a power feed line connected to the first conductor or the second conductor, wherein the first conductor and the second conductor are electrically connected without using a connecting member, and wherein unit cells including the first opening and the interconnect are repeatedly arranged.

24. A communication apparatus comprising:

a resonator antenna; and a communication processing section connected to the resonator antenna, wherein the resonator antenna includes a first conductor;

a second conductor of which at least a portion faces the first conductor;

a plurality of first openings provided in the first conductor;

a plurality of third conductors, each third conductor having an island shape and provided in a respective one of the first openings separately from the first conductor;

a chip inductor, provided in the third conductor, which connects the third conductor to the first conductor; and a power feed line connected to the first conductor or the second conductor, wherein the first conductor and the second conductor are electrically connected without using a connecting member, and wherein unit cells including the first opening and the third conductors are repeatedly arranged.

* * * * *